US005195168A

United States Patent [19]

Yong

[11] Patent Number: 5,195,168

[45] Date of Patent: Mar. 16, 1993

[54] SPEECH CODER AND METHOD HAVING SPECTRAL INTERPOLATION AND FAST CODEBOOK SEARCH

[75] Inventor: Mei Yong, Stoughton, Mass.

[73] Assignee: Codex Corporation, Mansfield, Mass.

[21] Appl. No.: 669,831

[22] Filed: Mar. 15, 1991

[51] Int. Cl.[5] ..... G10L 9/04

[52] U.S. Cl. ..... 395/2

[58] Field of Search ..... 381/29-41; 395/2; 358/133

[56] References Cited

U.S. PATENT DOCUMENTS

| | | | |
|---|---|---|---|
| 3,631,520 | 12/1971 | Atal . | |
| 4,133,976 | 1/1979 | Atal et al. . | |
| 4,220,819 | 9/1980 | Atal . | |
| 4,896,361 | 1/1990 | Gerson | 381/40 |
| 4,905,288 | 2/1990 | Gerson et al. . | |
| 5,007,092 | 4/1991 | Galand et al. | 381/36 |

OTHER PUBLICATIONS

An Expandable Error-Protected 4800 BPS CELP Coder (U.S. Federal Standard 4800 BPS Voice Coder) by Campbell et al., IEEE, CH2673-2/89/0000-0735, 1989, pp. 735-738.

Improved Speech Quality and Efficient Vector Quantization in Selp, by Krasinski et al., IEEE, CH2561-9-8-8-0000-0155, 1988, pp. 155-158.

Vector Sum Excited Linear Prediction (VSELP) Speech Coding at 8 KBPS by Gerson et al., IEEE, CH2847, 2-90-0000-0461, 1990, pp. 461-464.

Spectral Quantization and Interpolation For CEKP Coders, by Atal et al., IEEE, CH2673-2/89/0000-0069, 1989, pp. 69-72.

*Primary Examiner*—Michael R. Fleming
*Assistant Examiner*—Michelle Doerrler
*Attorney, Agent, or Firm*—Darleen J. Stockley

[57] ABSTRACT

A novel spectral interpolation and efficient excitation codebook search method developed for a Code-Excited Linear Predictive (CELP) speech coder is set forth. The interpolation is performed on an impulse response of the spectral synthesis filter. As the result of using this new set of interpolation parameters, the computations associated with an excitation codebook search in a CELP coder are considerably reduced. Furthermore, a coder utilizing this new interpolation approach provides noticeable improvement in speech quality coded at low bit-rates.

75 Claims, 5 Drawing Sheets

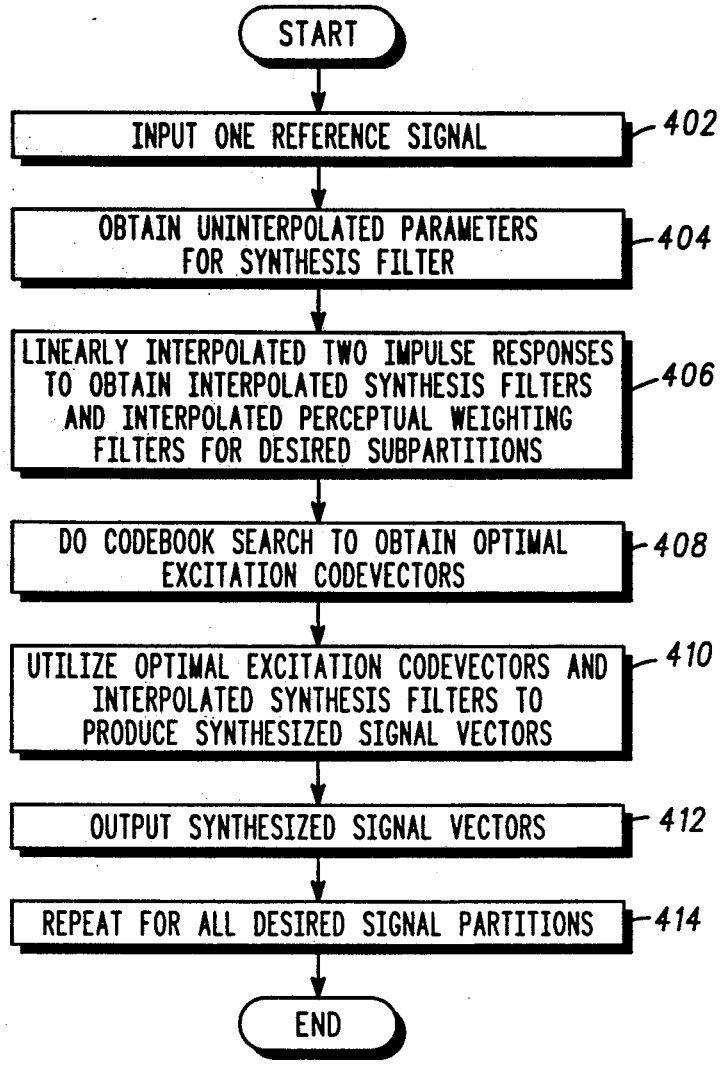
FIG. 4
400
FIG. 6
600
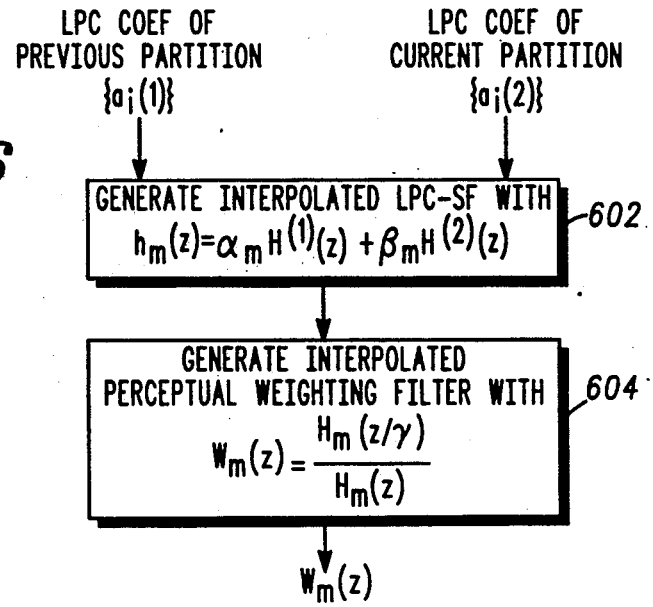

SPEECH CODER AND METHOD HAVING SPECTRAL INTERPOLATION AND FAST CODEBOOK SEARCH

FIELD OF THE INVENTION

The present invention relates generally to the high quality and low bit rate coding of communication signals and, more particularly, to more efficient coding of speech signals in the linear predictive coding techniques and in speech coders.

BACKGROUND OF THE INVENTION

Code-Excited Linear Prediction (CELP) is a widely used low bit-rate speech coding technique. Typically, a speech coder utilizing CELP achieves efficient coding of speech signals by exploiting the long-term and short term correlation of a speech waveform, and by utilizing the vector quantization, perceptual spectral weighting and analysis-by-synthesis techniques to reduce the bit-rate required to represent the speech waveform. The CELP-type speech coders typically include at least a codebook containing a set of excitation codevectors, a gain adjuster, and a spectral synthesis filter. The spectral synthesis filter is typically obtained by analyzing a segment of input speech waveform using the linear prediction technique. Thus, the spectral synthesis filter used in the CELP coders is usually called the LPC (i.e., Linear Predictive Coding) synthesis filter. Indices of selected excitation codevectors, quantized gains and the parameters of the LPC synthesis filter are transmitted or stored for reproducing a digital coded signal. The LPC synthesis filter conveys signal spectral information, and the spectral information is typically updated and transmitted once every frame (typically between 20 and 30 milliseconds) due to the bit-rate constraint. However, updating the LPC parameters in such piecewise fashion often results in discontinuity of the short-term synthesis filter at frame boundaries. Linear interpolation of the LPC synthesis filter parameters between two adjacent speech frames has been suggested previously to smooth spectral transitions without increasing the transmission bit-rate. However, conventional approaches of such interpolation lead to a significant increase in encoding complexity. There is a need for developing more efficient interpolation method that not only achieves the goal of smoothing the filter transitions, but also requires low encoding complexity.

SUMMARY OF THE INVENTION

A device, system, and method are provided for substantially reconstructing a signal, the signal being partitioned into successive time intervals, each time interval signal partition having a representative input reference signal with a set of vectors, and having at least a first representative electrical signal for each representative input reference signal of each time interval signal partition. The method, system, and device utilize at least a codebook unit having at least a codebook memory, a gain adjuster where desired, a synthesis unit having at least a first synthesis filter, a combiner, and a perceptual weighting unit having at least a first perceptual weighting filter, for utilizing the electrical signals of the representative input reference signals to at least generate a related set of synthesized signal vectors for substantially reconstructing the signal.

A synthesis unit utilizes the at least first representative electrical signal for each representative input reference signal for a selected time signal partition to obtain a set of uninterpolated parameters for the at least first synthesis filter. The at least first synthesis unit, utilizing the at least first synthesis filter, obtains the corresponding impulse response representation, and then interpolates the impulse responses of each selected adjacent time signal partition and of a current time signal partition immediately thereafter to provide a set of interpolated synthesis filters for desired subpartitions. The interpolated synthesis filters provide a corresponding set of interpolated perceptual weighting filters for desired subpartitions such that smooth transitions of the synthesis filter and the perceptual weighting filter between each pair of adjacent partitions are obtained. The codebook unit utilizes the set of input reference signal vectors, the related set of interpolated synthesis filters and the related set of interpolated perceptual weighting filters for the current time signal partition to select a corresponding set of optimal excitation codevectors from the at least first codebook memory.

Further, for each desired input reference signal vector: (1) a particular excitation codevector is provided from the at least first codebook memory of the codebook unit, the codebook memory having a set of excitation codevectors stored therein responsive to the representative input vectorsl (2) where desired, the gain adjuster, responsive to the particular excitation codevector, multiplies that codevector by a selected excitation gain factor to substantially provide correlation with an energy of the representative electrical signal for each representative input reference signal vector; (3) the corresponding interpolated synthesis filter, responsive to the particular excitation codevector multiplied by the particular gain, produces the synthesized signal vector; (4) the combiner, responsive to the synthesized signal vector and to the input reference signal vector, subtracts the synthesized signal vector from the input reference signal vector related thereto to obtain a corresponding reconstruction error vector; (5) an interpolated perceptual weighting unit, responsive to the corresponding reconstruction error vector, determines a corresponding perceptually weighted squared error; (6) a selector, responsive to the corresponding perceptually weighted squared error, stores an index of a codevector having the perceptually weighted squared error that it determines to be smaller than all other errors produced by other codevectors; (7) the device, system and method repeat the steps (1),(2),(3),(4),(5), and (6) for every excitation codevector in the codebook memory and implement these steps utilizing a fast codebook search method, to determine an optimal excitation codevector for the related input reference signal vector; and the codebook unit successively inputs the set of selected optimal excitation codevectors multiplied by the set of selected gains where desired, into the corresponding set of interpolated synthesis filters to produce the related set of synthesized signal vectors for the given input reference signal for substantially reconstructing the input signal.

BRIEF DESCRIPTION OF THE DRAWINGS

FIG. 4 is a flowchart diagram showing the general sequence of steps performed by a digital speech coder transmitter that utilizes the present invention.

FIG. 6 is a flowchart diagram that illustrates a second manner in which an LPC-SF synthesis filter and perceptual weighting filter for the m-th subpartition may be implemented in accordance with the present invention.

DETAILED DESCRIPTION OF A PREFERRED EMBODIMENT

Figure 1:
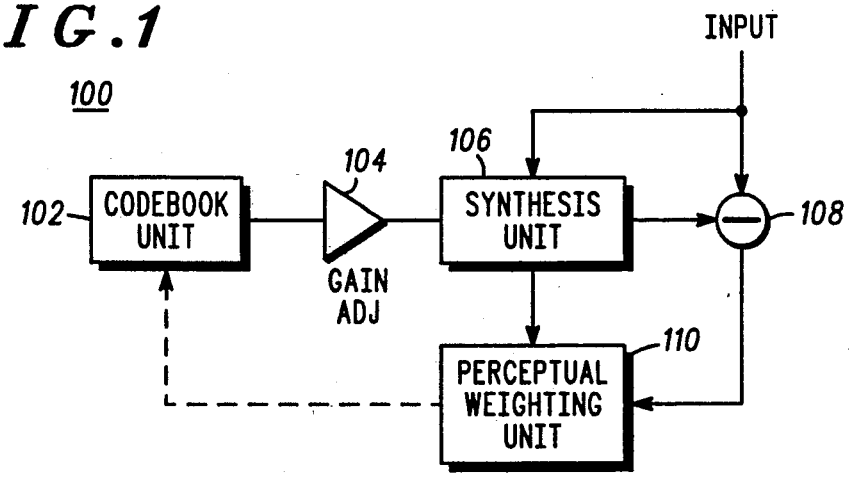
FIG. 1 is a general block schematic diagram of a first embodiment of a digital speech coder encoder unit that utilizes the present invention.

FIG. 1, numeral 100, illustrates a general block schematic diagram of a digital speech coder transmitter unit that utilizes the present invention to signal process an input signal utilizing at least a codebook unit (102), having at least a first codebook memory means, a gain adjuster (104) where desired, at least a first synthesis unit (106) having at least a first synthesis filter, a combiner (108), and a perceptual weighting unit (110), to substantially reconstruct the input signal, typically a speech waveform. The input signal is partitioned into successive time intervals, each time interval signal partition having a representative input vector having at least a first representative electrical signal. Electrical signals of the representative input vectors are utilized to at least generate a related set of synthesized signal vectors that may be utilized to substantially reconstruct the input signal. The at least first codebook memory means provides particular excitation codevectors from the codebook memory of the codebook unit (102), the codebook memory having a set of excitation codevectors stored therein responsive to the representative input vectors. Generally, the codebook unit (102) comprises at least a codebook memory storage for storing particular excitation codevectors, a codebook search controller, and a codebook excitation vector optimizer for determining an optimal excitation codebook vector. Where desired, a gain adjuster (104), typically an amplifier, multiplies the particular excitation codevectors by a selected excitation gain vector to substantially provide correlation with an energy of the representative input vector. The at least first representative electrical signal for each representative input reference signal of each time interval signal partition and the particular excitation codevector, where desired adjusted by multiplication by the selected gain vector, are input into the synthesis unit (106).

Figure 2:
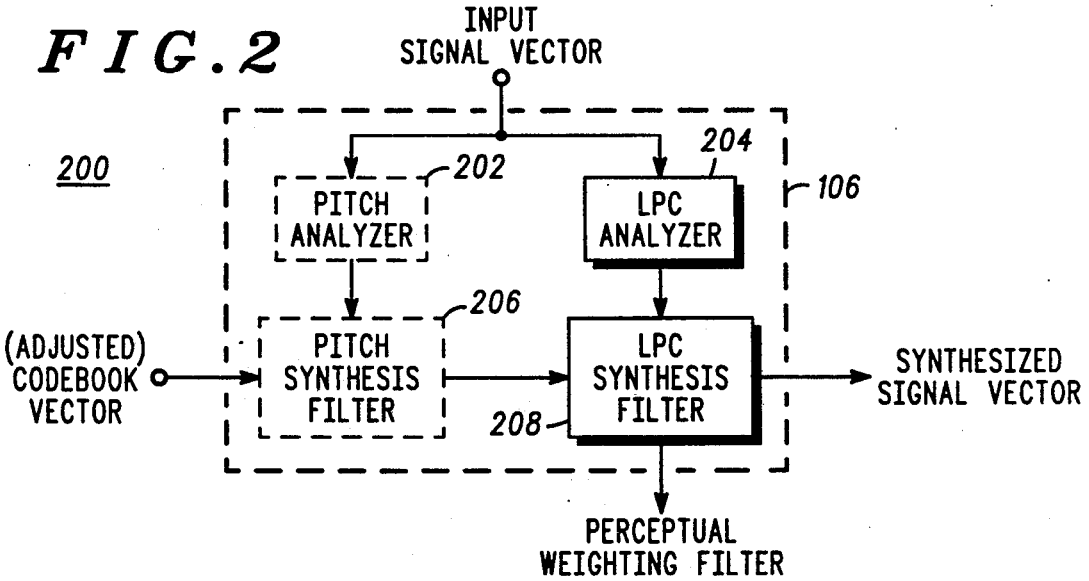
FIG. 2 is a detailed block schematic diagram of a first embodiment of a synthesis unit of FIG. 1 in accordance with the present invention.

FIG. 2, numeral 200, is a detailed block schematic diagram of a first embodiment of an at least first synthesis unit (106) of FIG. 1 in accordance with the present invention. The at least first synthesis filter obtains a corresponding synthesized signal vector for each representative input signal vector. An at least first synthesis unit (106) may include a pitch analyzer (202) if desired and a pitch synthesis filter (206) if desired, to obtain a long term predictor for further adjusting an adjusted codebook vector. A first synthesis unit typically further comprises at least a LPC analyzer (204) and at least a first LPC synthesis filter (208).

Figure 3:
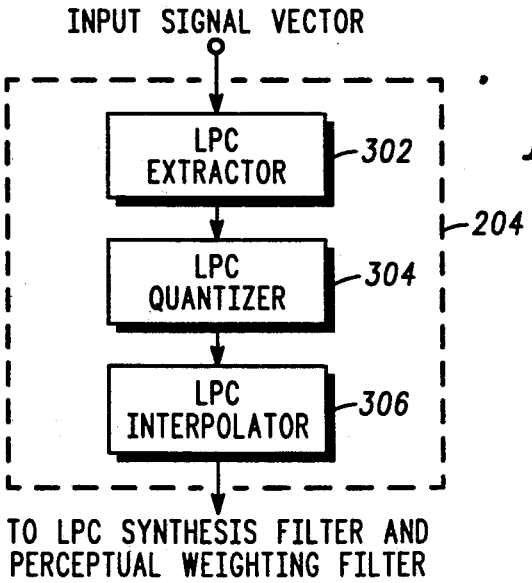
FIG. 3 is a detailed block schematic diagram of a LPC analyzer of FIG. 2 in accordance with the present invention.

FIG. 3, numeral 300, is a detailed block schematic diagram of a LPC analyzer (204) of FIG. 2 in accordance with the present invention. The LPC analyzer (204) typically utilizes a LPC extractor (302) to obtain parameters from a partitioned input signal, quantizes the parameters of time signal partitions with an LPC quantizer (304), and interpolates the parameters of two adjacent time signal partitions with an LPC interpolator (306) as set forth immediately following.

The at least first synthesis filter is typically at least a first time-varying linear predictive coding synthesis filter (LPC-SF) (208) having a transfer function substantially of a form:

$$H(z) = \frac{1}{1 - \sum_{i=1}^{p} a_i z^{-i}},$$

where $a_i$'s, for $i=1,2,\ldots,p$ represent a set of estimated prediction coefficients obtained by analyzing the corresponding time signal partition and p represents a predictor order. The LPC-SFs of a selected adjacent time signal partition and of a time partition immediately thereafter are substantially of a form:

$$H^{(j)}(z) = \frac{1}{1 - \sum_{i=1}^{p} a_i^{(j)} z^{-i}},$$

where $a_i^{(j)}$'s, for $i=1, 2, 3, \ldots, p$ and $j=1, 2$ represent a set of prediction coefficients in a selected adjacent time signal partition when $j=1$ and of a current time signal partition immediately thereafter when $j=2$, respectively, p represents a predictor order such that an impulse response for the transfer function $H^{(j)}(z)$ is substantially $$h^{(j)}(n) = \partial(n) + \sum_{i=1}^{p} a_i^{(j)} h^{(j)}(n-i),$$

where $\partial(n)$ is an impulse function, and such that the impulse response of the at least first synthesis filter at an m-th subpartition of a current time partition obtained through linear interpolation of $h^{(1)}(n)$ and $h^{(2)}(n)$ respectively, denoted below as $h_m(n)$, is substantially:

$$h_m(n) = \alpha_m h^{(1)}(n) + \beta_m h^{(2)}(n),$$

where $\beta_m = 1 - \alpha_m$ and $0 < \alpha_m < 1$, where a different $\alpha_m$ is utilized for each subpartition, thereby providing a transfer function of the interpolated synthesis filter substantially of a form:

$$H_m(z) = \alpha_m H^{(1)}(z) + \beta_m H^{(2)}(z) = \frac{A'_m(z)}{A^{(1)}(z) A^{(2)}(z)},$$

where $$A'_m(z) = 1 - \sum_{i=1}^{p} (\beta_m a_i^{(1)} + \alpha_m a_i^{(2)}) z^{-i}$$

and

-continued $$A^{(j)}(z) = 1 - \sum_{i=1}^{p} a_i^{(j)} z^{-i} \text{ for } j = 1,2,$$

wherein the perceptual weighting filter at the m-th subpartition of a current time interval signal partition substantially has a transfer function of the form:

$$W_m(z) = \frac{A^{(1)}(z)A^{(2)}(z)}{A'_m(z)} H_m(z/\gamma),$$

where $\gamma$ is typically selected to be substantially 0.8.

For a fast codebook search method, in a second embodiment, the synthesis filter (208) may be approximated by an all pole synthesis filter that is utilized to provide parameters for interpolating subpartitions in the LPC-SF filter and in the perceptual weighting filter, wherein the all pole synthesis filter substantially utilizes at least: an estimating unit, responsive to selected interpolated impulse response samples, for estimating a first p+1 autocorrelation coefficients using selected truncated interpolated impulse response samples; and a converting unit, responsive to the estimated correlation coefficients, for converting the autocorrelation coefficients to direct form prediction coefficients using a recursion algorithm.

The estimated autocorrelation coefficients at the m-th subpartition can be expressed as:

$$\hat{R}_m(k) = \sum_n h_m(n) h_m(n+k)$$

for k=0,1, . . . , p and the summation is over all available partition impulse responses, such that $$\hat{R}_m(k) = \alpha_m^2 \hat{R}^{(1)}(k) + \beta_m^2 \hat{R}^{(2)}(k) + \alpha_m \beta_m (\hat{R}^{(12)}(k) + \hat{R}^{(21)}(k))$$

where $$\hat{R}^{(j)}(k) = \sum_n h^{(j)}(n) h^{(j)}(n+k) \text{ for } k = 0,1,\ldots,p \text{ and } j = 1,2,$$

are autocorrelation coefficients of uninterpolated impulse response of the adjacent and current partitions, and $$\hat{R}^{(ij)}(k) = \sum_n h^{(i)}(n) h^{(j)}(n+k) \text{ for } k = 0,1,\ldots,p$$

and i,j=1,2 where i≠j, are cross-correlation coefficients between the uninterpolated impulse responses.

Where desired, the synthesis unit further includes a pitch synthesis unit, the pitch synthesis unit including at least a pitch analyzer and a time-varying pitch synthesis filter having a transfer function substantially of a form:

$$B(z) = \frac{1}{1 - \beta z^{-T}},$$

where T represents an estimated pitch lag and $\beta$ represents gain of the pitch predictor.

The perceptual weighting unit, responsive to the transfer function of the interpolated synthesis filter and to output of the combiner, includes at least a first perceptual weighting filter having a transfer function substantially of a form:

$$W(z) = \frac{H(z/\gamma)}{H(z)},$$

where $\gamma$ is typically selected to be substantially 0.8.

Excitation code vectors are typically stored in memory, and the codebook unit, responsive to the perceptual weighted squared error, signal processes each selected input reference vector such that every excitation codevector in the codebook memory is signal processed for each selected input reference vector, and determines the optimal excitation codevector in the codebook memory.

The codebook unit, responsive to the impulse response of the at least first synthesis filter, utilizes a fast codebook search, wherein substantially the perceptually weighted squared error between an input signal vector and a related synthesized codevector utilizing an i-th excitation codevector, denoting this error by $E_i$, is determined such that:

$$E_i = ||x||^2 - \frac{A_i^2}{B_i},$$

where x represents an input target vector at a selected subpartition that is substantially equal to an input reference signal vector at a selected subpartition filtered by a corresponding interpolated weighting filter with a zero-input response of a corresponding interpolated weighted LPC-SF subtracted from it, $A_i$ represents a dot product of the vector x and an i-th filtered codevector $y_{i,m}$ at an m-th subpartition, and $B_i$ represents the squared norm of the vector $y_{i,m}$. The corresponding interpolated weighted LPC-SF has a transfer function of $H_m(z/\gamma)$, such that:

$$H_m(z/\gamma) = \frac{1}{1 - \sum_{i=1}^{p} \gamma^m a_{i,m} z^{-i}},$$

where for an m-th subpartition, $\gamma$ is typically selected to be 0.8, and $a_{i,m}$, for i=1,2, . . . p, such that p is a predictor order, represent the parameters of corresponding interpolated LPC-SF, the impulse response of $H_m(z/\gamma)$, $h_{wm}(n)$, is substantially equal to:

$$h_{wm}(n) = \gamma^n h_m(n),$$

and where $h_m(n)$ is an impulse response of corresponding LPC-SF, utilizing a fact that $h_m(n)$ is a linear interpolation of the impulse responses of related previous and current uninterpolated LPC-SFs, $h_{wm}(n)$, at each interpolating subpartition, determined in a fast codebook search as a linear interpolation of two impulse responses of related previous and current uninterpolated weighted LPC-SFs:

$$h_{wm}(n) = \alpha_m h_w^{(1)}(n) + \beta_m h_w^{(2)}(n),$$

where $h_w^{(j)}(n) = \gamma^n h^{(j)}(n)$ for j=1,2 are exponentially weighted uninterpolated impulse responses of the previous, when j=1, and the current, when j=2, LPC synthesis filters, and where $\beta_m = 1 - \alpha_m$ and $0 < \alpha_m < 1$, where a different $\alpha_m$ is utilized for each subpartition. The filtered codevector $y_{i,m}$ is determined as a convolution of the i-th excitation codevector $c_i$ with the corresponding weighted impulse response $h_{wm}(n)$, the convolution being substantially:

$y_{i,m}=F_{wm}c_i$, where $$F_{wm}=\begin{bmatrix} h_{wm}(0) & 0 & 0 & \dots & 0 \\ h_{wm}(1) & h_{wm}(0) & 0 & \dots & 0 \\ h_{wm}(2) & h_{wm}(1) & h_{wm}(0) & \dots & 0 \\ . & . & . & \dots & . \\ . & . & . & \dots & . \\ . & . & . & \dots & . \\ h_{wm}(k-1) & h_{wm}(k-2) & h_{wm}(k-3) & \dots & h_{wm}(0) \end{bmatrix}$$

and where k represents a dimension of a codevector, further utilizing the fact that $h_{wm}(n)$ is a linear interpolation of the impulse responses of related previous and current uninterpolated weighted LPC-SFs, the filtered codevector $y_{i,m}$ at each interpolating subpartition may be substantially determined as linear interpolation of two codevectors filtered by the related previous and current uninterpolated weighted LPC-SFs:

$$y_{i,m}=\alpha_m y_i^{(1)}+\beta_m y_i^{(2)},$$

and where $y_i^{(j)}=F_w^{(j)}c_i$ for j=1,2 and where matrices $F_w^{(1)}$ and $F_w^{(2)}$ have substantially a same format as the matrix $F_{wm}$, but with different elements $h_w^{(1)}(n)$ and $h_w^{(2)}(n)$, respectively.

The squared norm $B_i$ at each interpolating subpartition is substantially a weighted sum of a squared norm of a filtered codevector $y_i^{(1)}$, the squared norm of the filtered codevector $y_i^{(2)}$, and a dot product of those two filtered codevectors, substantially being:

$$B_i=\alpha_m^2||y_i^{(1)}||^2+\beta_m^2||y_i^{(2)}||^2+2\alpha_m\beta_m<y_i^{(1)}\cdot y_i^{(2)}>,$$

where $\beta_m=1-\alpha_m$ and $0<\alpha_m<1$, where a different $\alpha_m$ is utilized for each subpartition. The codebook unit determines of the dot product $A_i$ for each interpolating subpartition substantially utilizing a backward filter, responsive to the matrix $F_{wm}$ and an input signal vector x such that $z=F^t_{wm}x$, where t represents a transpose operator and a dot product determiner for forming a dot product such that:

$$A_i=<z\cdot c_i>,$$

where $c_i$ is the ith excitation codevector.

A combiner (108), typically a subtractor, subtracts each first corrected corresponding synthesized signal vector from the input reference vector related thereto, that related input reference vector being a vector from a set of vectors for the input reference signal, to obtain a corresponding reconstruction error vector. The perceptual weighting unit (110) weights the reconstruction error vectors, utilizing the at least first perceptual weighting filter, wherein, for each selected subpartition, second corrections of partition parameter discontinuities are applied, substantially providing corrected reconstruction error vectors, and further determining corrected perceptual weighted squared error.

The corrected perceptual weighted squared error is utilized by the codebook unit to determine an optimal excitation codevector from the codebook memory for each input reference vector. A selector, responsive to the corresponding perceptually weighted squared error is utilized to determine and store an index of a codevector having a perceptually weighted squared error smaller than all other errors produced by other codevectors. Where desired, the gain adjuster (104) is utilized to multiply the optimal excitation codevectors by particular gain factors to substantially provide adjusted, where desired, optimal excitation codevectors correlated with an energy of the representative input reference signal such that the selected adjusted, where desired, optimal excitation codevectors are signal processed in the at least first synthesis unit (106) to substantially produce synthesized signal vectors for reconstructing the input signal.

Typically, every excitation codevector for each input reference vector is signal processed to determine an optimal excitation codevector from the codebook memory for each input reference vector.

Figure 4A:
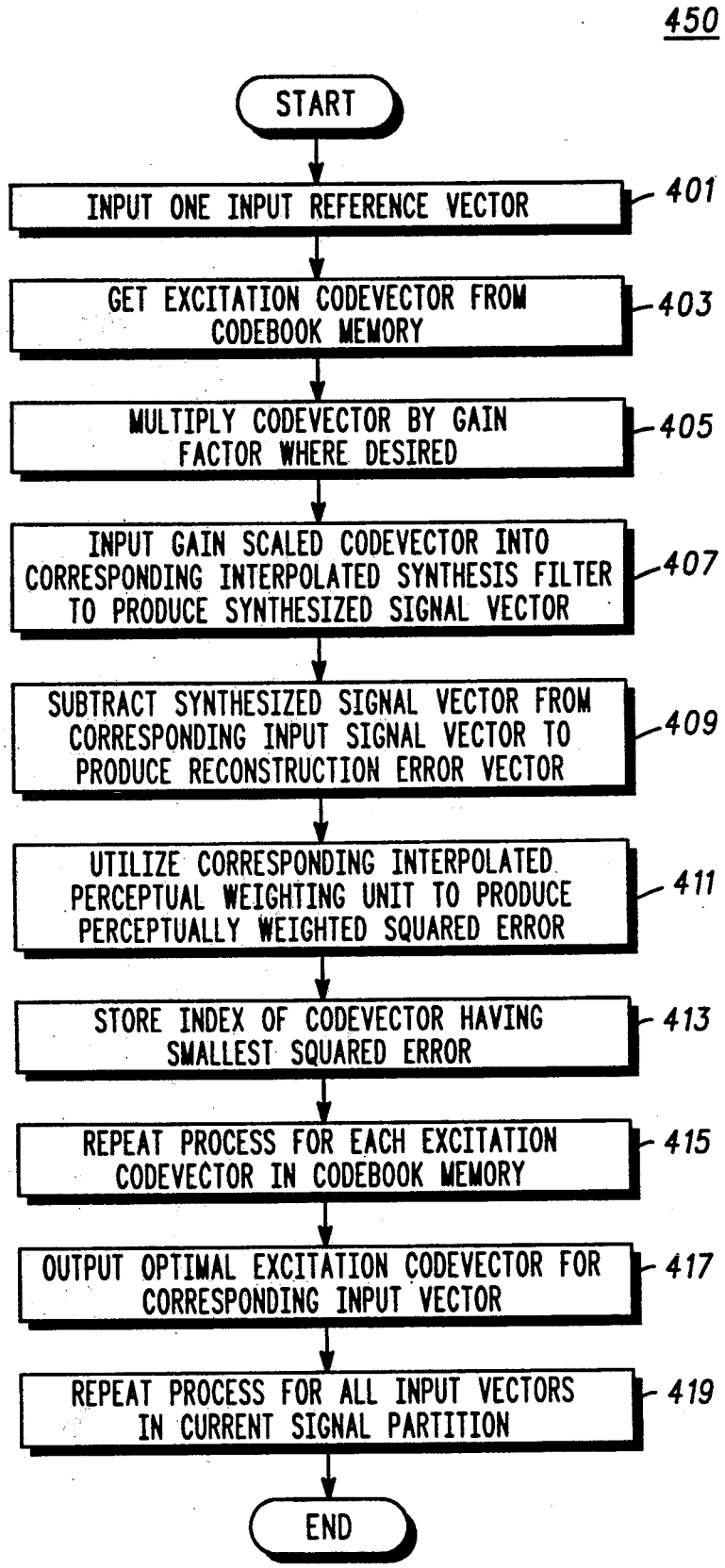
FIG. 4A is a flowchart diagram that illustrates a first embodiment of a fast codebook search in accordance with the present invention.

FIGS. 4 and 4A, numeral 400 and 450, are a flowchart diagram showing the general sequence of steps performed by a digital speech coder transmitter that utilizes the present invention, and a flowchart diagram that illustrates a first embodiment of a fast codebook search in accordance with the present invention, respectively.

The method for substantially reconstructing an input signal, typically a speech waveform, provides that, the signal being partitioned into successive time intervals, each time interval signal partition having a representative input reference signal (402) with a set of vectors, and having at least a first representative electrical signal for each representative input reference signal of each time interval signal partition, the method utilizes at least a codebook unit having at least a codebook memory, a gain adjuster where desired, a synthesis unit having at least a first synthesis filter, a combiner, and a perceptual weighting unit having at least a first perceptual weighting filter, for utilizing the electrical signals of the representative input reference signals to at least generate a related set of synthesized signal vectors for substantially reconstructing the signal.

The method substantially comprises the steps of: (A) utilizing the at least first representative electrical signal for each representative input reference signal (402) for a selected time signal partition to obtain a set of uninterpolated parameters for the at least first synthesis filter (404), then (B) utilizing the at least first synthesis filter to obtain the corresponding impulse response representation, and interpolating the impulse responses of each selected adjacent time signal partition and of a current time signal partition immediately thereafter to provide a set of interpolated synthesis filters for desired subpartitions; and utilizing the interpolated synthesis filters to provide a corresponding set of interpolated perceptual weighting filters for desired subpartitions (406). Interpolation provides for smooth transitions of the synthesis filter and the perceptual weighting filter between each pair of adjacent partitions are obtained.

Next, (C), the set of input reference signal vectors, the related set of interpolated synthesis filters and the related set of interpolated perceptual weighting filters for the current time signal partition are utilized to select the corresponding set of optimal excitation codevectors from the at least first codebook memory (408), further implementing the following steps for each desired input reference signal vector (401): (1) providing a particular excitation codevector from the at least first codebook memory, the codebook memory having a set of excitation codevectors stored therein responsive to the representative input vectors (403); (2) where desired, multiplying the particular excitation codevector by a selected excitation gain factor to substantially provide correlation with an energy of the representative electrical signal for each representative input reference signal vector (405); (3) inputting the particular excitation codevector multiplied by the particular gain into the corresponding interpolated synthesis filter to produce the synthesized signal vector (407); (4) subtracting the synthesized signal vector from the input reference signal vector related thereto to obtain a corresponding reconstruction error vector (409); (5) inputting the reconstruction error vector into the corresponding interpolated perceptual weighting unit to determine a corresponding perceptually weighted squared error (411); (6) storing index of codevector having the perceptually weighted squared error smaller than all other errors produced by other codevectors (413); (7) repeating the steps (1),(2),(3),(4),(5), and (6) for every excitation codevector in the codebook memory (415) and implementing these steps utilizing a fast codebook search method, to determine an optimal excitation codevector for the related input reference signal vector (410,417); and (D) successively inputting the set of selected optimal excitation codevectors multiplied by the set of selected gains where desired, into the corresponding set of interpolated synthesis filters (419) to produce the related set of synthesized signal vectors (412) for the given input reference signal for substantially reconstructing the input signal (414).

As set forth above, the method typically utilizes the at least first synthesis filter, substantially at least a first time-varying linear predictive coding synthesis filter (LPC-SF) where $\gamma$ is typically selected to be substantially 0.8, generally approximated by an all pole synthesis filter that is utilized to provide parameters for interpolating subpartitions in the LPC-SF filter and in the perceptual weighting filter.

Figure 5:
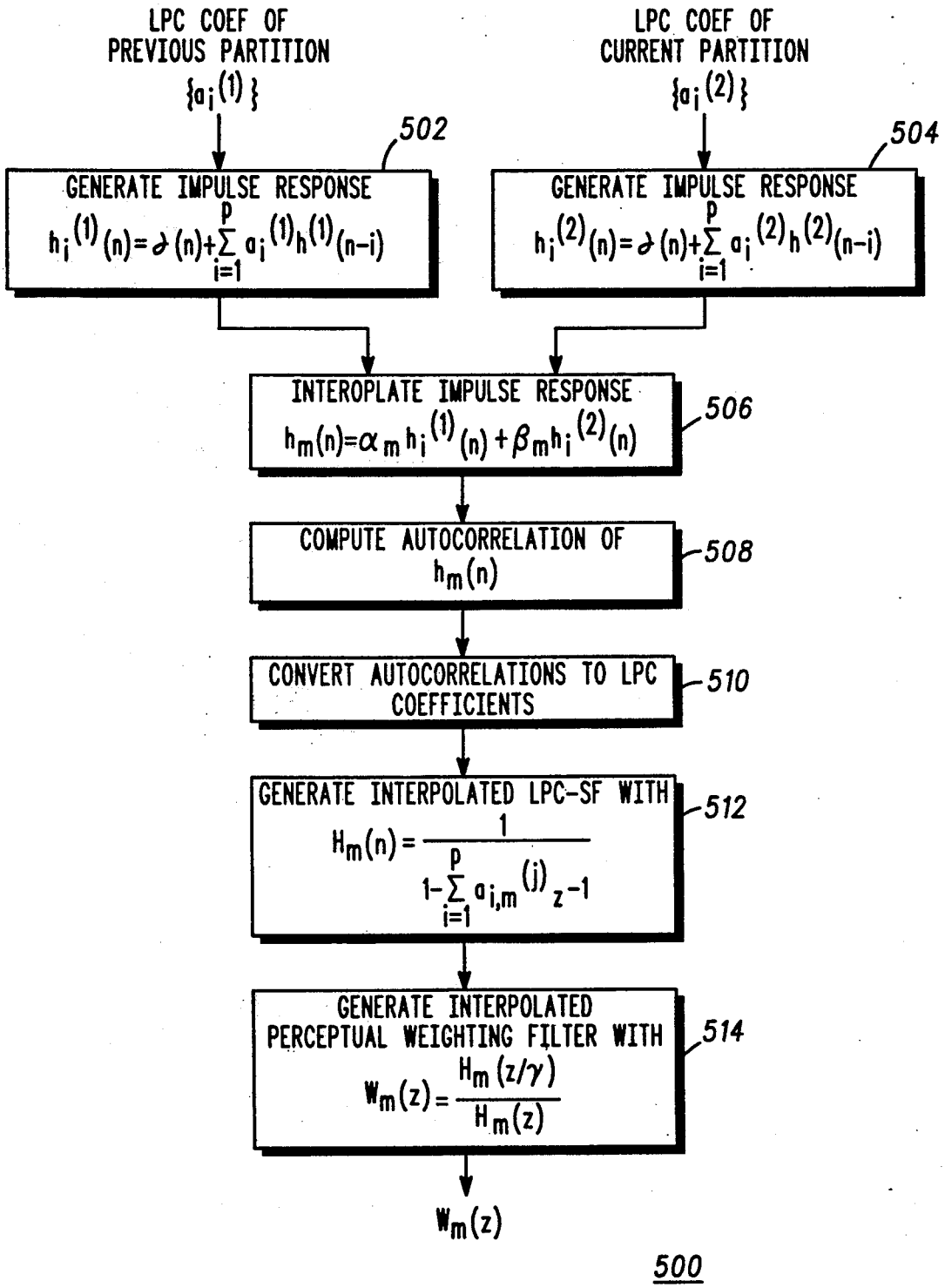
FIG. 5 is a flowchart diagram that illustrates a first manner in which an LPC-SF synthesis filter and perceptual weighting filter for the m-th subpartition may be implemented in accordance with the present invention.

FIG. 5, numeral 500, is a flowchart diagram that illustrates a first manner in which an LPC-SF synthesis filter and perceptual weighting filter for the m-th subpartition may be implemented in accordance with the present invention. LPC coefficients of a previous time signal partition $\{a_i^{(1)}\}$ and of a current time signal partition immediately thereafter $\{a_i^{(2)}\}$ are each utilized to generate impulse responses (502, 504) from an LPC-SF, being $$h^{(1)}(n) = \partial(n) + \sum_{i=1}^{p} a^{(1)}h^{(1)}(n-i)$$

and $$h^{(2)}(n) = \partial(n) + \sum_{i=1}^{p} a^{(2)}h^{(2)}(n-i),$$

respectively, where $\partial(n)$ is an impulse function and $a_i^{(j)}$, for the set $i=1,2,\ldots,p$ and $j=1,2$, represents a set of quantized prediction coefficients in a previous time partition for $j=1$ and the current time partition for $j=2$. $h^{(j)}(n)$ represents the impulse response of an LPC-SF. The impulse responses for the previous time partition input and the current time partition input are interpolated to obtain the interpolated impulse response (506), substantially, $h_m(n)=\alpha_m h^{(1)}(n)+\beta_m h^{(2)}(n)$, where $\beta_m=1-\alpha_m$ and $0<\alpha_m<1$. Autocorrelations of $h_m(n)$ are determined (508), that are then converted to LPC coefficients (510), substantially generating, for selected subpartitions, an interpolated LPC-SF having $$H_m(z) = \frac{1}{1 - \sum_{i=1}^{p} a_i^{(j)} z^{-i}}$$

for $j=1,2$, and an interpolated perceptual weighting filter having $$W_m(z) = \frac{H(z/\gamma)}{H(z)}$$

wherein $\gamma$ is substantially 0.8.

FIG. 6, numeral 600, is a flowchart diagram that illustrates a second manner in which an LPC-SF synthesis filter and perceptual weighting filter for the m-th subpartition may be implemented in accordance with the present invention.

LPC coefficients of a previous time signal partition $\{a_i^{(1)}\}$ and of a current time signal partition immediately thereafter $\{a_i^{(2)}\}$ are each utilized to generate, for each desired subpartition, an interpolated LPC-SF (602) having $H_m(z)=\alpha_m H^{(1)}(z)+\beta_m H^{(2)}(z)$, substantially being a corresponding z-transform of the interpolated synthesis filter (506), and coefficients being as set forth above, and also an interpolated weighting filter (604), having $$W_m(z) = \frac{H_m(z/\gamma)}{H_m(z)},$$

coefficients being as set forth above. A system implementing the method of this invention also may be utilized in accordance with the method described above.

Figure 7:
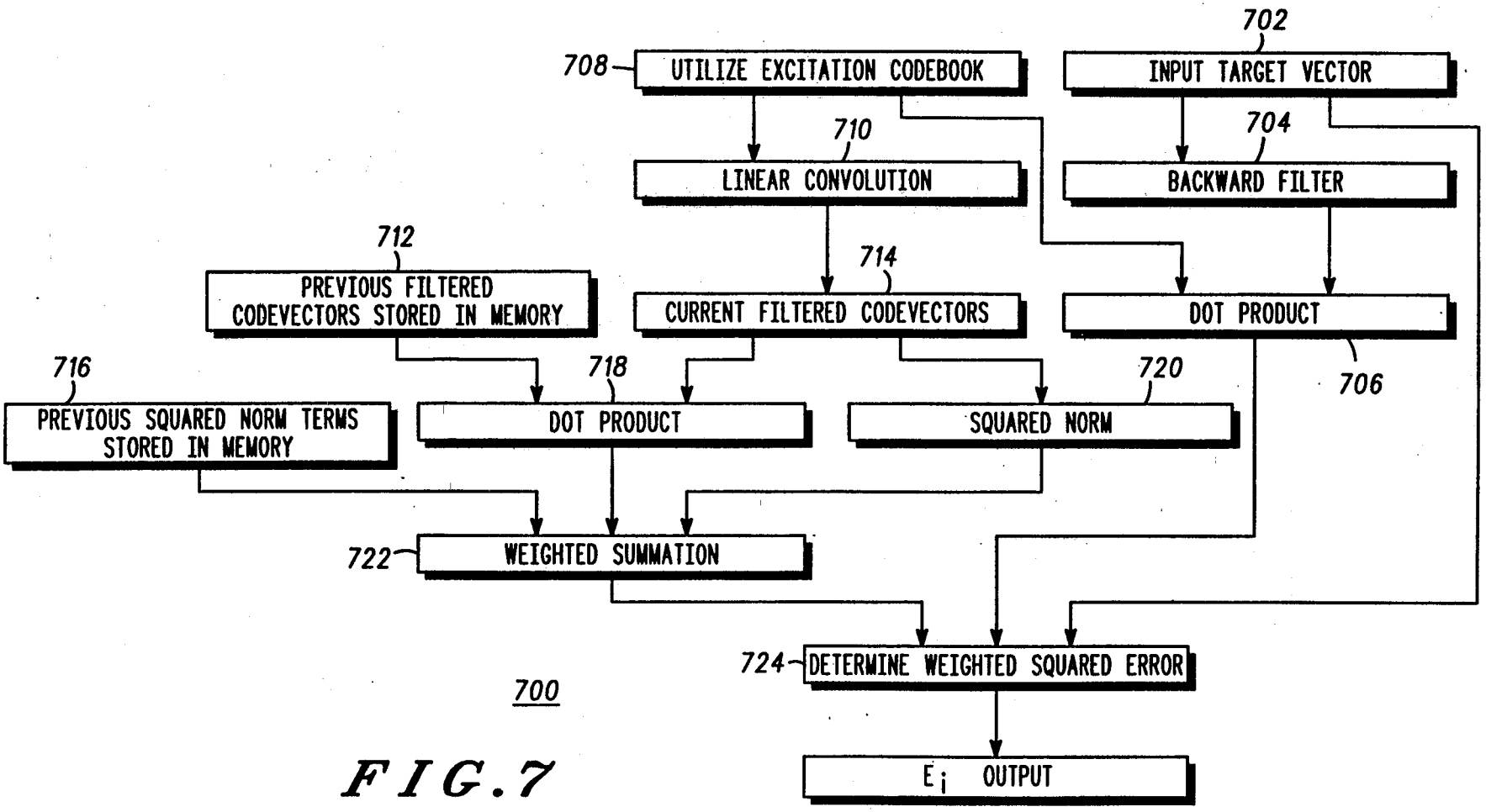
FIG. 7 is a flowchart diagram that illustrates a detailed fast codebook search method to determine weighted squared error in accordance with the present invention.

FIG. 7, numeral 700, is a flowchart diagram that illustrates a detailed fast codebook search method to determine weighted squared error in accordance with the present invention. The fast codebook search method substantially further includes utilizing a simplified method to determine the perceptually weighted squared error (724) between an input signal vector (401) and a related synthesized codevector utilizing an i-th excitation codevector (708) denoting this error by $E_i$, such that:

$$E_i = ||x||^2 - \frac{A_i^2}{B_i},$$

where x represents an input target vector (702) at a selected subpartition that is substantially equal to an input reference signal vector at a selected subpartition filtered by a corresponding interpolated weighting filter with a zero-input response of a corresponding interpolated weighted LPC-SF subtracted from it, $A_i$ represents a dot product of the vector x and an i-th filtered codevector $y_{i,m}$ at an m-th subpartition (706), and $B_i$ represents the squared norm of the vector $y_{i,m}$ (722). A corresponding interpolated weighted LPC-SF has a transfer function of $H_m(z/\gamma)$, such that:

$$H_m(z/\gamma) = \frac{1}{1 - \sum_{i=1}^{p} \gamma^m a_{i,m} z^{-i}},$$

where for an m-th subpartition, $\gamma$ is typically selected to be 0.8, and $a_{i,m}$, for $i=1,2,\ldots p$, such that p is a predictor order, represent the parameters of corresponding interpolated LPC-SF, the impulse response of $H(z/\gamma)$, $h_w(n)$, is substantially equal to:

$$h_w(n)=\gamma^n h_m(n),$$

and where $h_m(n)$ is an impulse response of corresponding LPC-SF, utilizing a fact that $h_m(n)$ is a linear interpolation of the impulse responses of related previous and current uninterpolated LPC-SFs, $h_{wm}(n)$, at each interpolating subpartition, determined in a fast codebook search as a linear interpolation of two impulse responses of related previous and current uninterpolated weighted LPC-SFs:

$$h_{wm}(n)=\alpha_m h_w^{(1)}(n)+\beta_m h_w^{(2)}(n),$$

where $h_w^{(j)}(n)=\gamma^n h^{(j)}(n)$ for $j=1,2$ are exponentially weighted uninterpolated impulse responses of the previous, when $j=1$, and the current, when $j=2$, uninterpolated signal partitions, and where $\beta_m=1-\alpha_m$ and $0<\alpha_m<1$, where a different $\alpha_m$ is utilized for each subpartition.

The filtered codevector $y_{i,m}$ is determined as a convolution (710), once per signal partition, of the i-th excitation codevector $c_i$ with the corresponding weighted impulse response $h_{wm}(n)$, the convolution being substantially:

$y_{i,m}=F_{wm}c_i$, where $$F_{wm}=\begin{bmatrix} h_{wm}(0) & 0 & 0 & \ldots & 0 \\ h_{wm}(1) & h_{wm}(0) & 0 & \ldots & 0 \\ h_{wm}(2) & h_{wm}(1) & h_{wm}(0) & \ldots & 0 \\ . & . & . & \ldots & . \\ . & . & . & \ldots & . \\ . & . & . & \ldots & . \\ h_{wm}(k-1) & h_{wm}(k-2) & h_{wm}(k-3) & \ldots & h_{wm}(0) \end{bmatrix}$$

and where k represents a dimension of a codevector, further utilizing the fact that $h_{wm}(n)$ is a linear interpolation of the impulse responses of related previous and current uninterpolated weighted LPC-SFs, the filtered codevector $y_{i,m}$ at each interpolating subpartition may be substantially determined as linear interpolation of two codevectors filtered by the related previous and current uninterpolated weighted LPC-SFs:

$$y_{i,m}=\alpha_m y_i^{(1)}+\beta_m y_i^{(2)},$$

and where $y_i^{(j)}=F_w^{(j)}c_i$ for $j=1,2$ and where matrices $F_w^{(1)}$ and $F_w^{(2)}$ have substantially a same format as the matrix $F_{wm}$, but with different elements $h_w^{(1)}(n)$ and $h_w^{(2)}(n)$, respectively. The squared norm $B_i$ at each interpolating subpartition is substantially a weighted sum (722) of a squared norm (716) of a filtered codevector $y_i^{(1)}$ (712), the squared norm (720) of the filtered codevector $y_i^{(2)}$ (714), and a dot product (718) of those two filtered codevectors, substantially being:

$$B_i=\alpha_m^2||y_i^{(1)}||^2+\beta_m^2||y_i^{(2)}||^2+2\alpha_m\beta_m<y_i^{(1)}\cdot y_i^{(2)}>,$$

where $\beta_m=1-\alpha_m$ and $0<\alpha_m<1$, where a different $\alpha_m$ is utilized for each subpartition. Determination of the dot product $A_i$ for each interpolating subpartition substantially comprises two steps:

A) backward filtering (704) such that $z=F^t_{wm}x$; and where t represents a transpose operator; and B) forming a dot product (706) such that:

$$A_i=<z\cdot c_i>,$$

where $c_i$ is the ith excitation codevector.

Then $A_i$, $B_i$, and x are utilized to determine error $E_i$, such that: substantially:

$$E_i=||x||^2-\frac{A_i^2}{B_i} \quad (724).$$

Backward filtering, dot product determination for $A_i$, dot production determination for $B_i$, determination of two squared norms, obtaining a weighted summation, and determining weighted squared error are performed for every desired interpolating subpartition.

This novel device, method, and system, typically implemented in a digital speech coder, provides for an interpolated synthesis filter for smoothing discontinuities in synthesized reconstructed signals caused by discontinuities at partition boundaries of sampled signals. This interpolated synthesis filter has two particularly important properties: a resulting synthesis filter $H_i(z)$ is guaranteed to be stable as long as the filter $H^{(1)}(z)$ and $H^{(2)}(z)$ are stable; and the resulting synthesis filter is a pole-zero filter that is different from the LPC modeling method based on an all-pole filter. Two embodiments, set forth above, provide for reconstruction of an LPC-SF and a perceptual weighting filter from the interpolated impulse response. The first embodiment, utilizing the pole-zero synthesis filter obtained from interpolating the impulse responses of two all-pole synthesis filters for adjacent time partitions generates an interpolated synthesis filter, and necessitates updating/interpolating of the perceptual weighting filter (604). The interpolated weighting filter (604) is not necessarily stable, requiring a stability check for each set of interpolated coefficients. Where instability is detected for a particular subpartition, uninterpolated coefficients are used for that subpartition.

To avoid the instability check associated with utilizing the pole-zero synthesis filter, a second embodiment utilizes an all-pole synthesis filter to approximate the pole-zero filter of the first embodiment. In the second embodiment, the first $p+1$ autocorrelation coefficients of the interpolated impulse response for a subpartition are estimated, then converted to direct form prediction coefficients, typically utilizing the Levinson recursion algorithm. The resulting prediction coefficients are utilized in a LPC-SF and a perceptual weighting filter for the subpartition. Thus, the required number of computations required to generate the first $p+1$ autocorrelation coefficients from the impulse responses per partition is substantially of the order of $3(p+1)L+4(p+1)N_{itp}$, where L is a length of a truncated/estimated impulse response and $N_{itp}$ is substantially a number of subpartitions where interpolation is performed. An important advantage of the second embodiment is that to determine the autocorrelation coefficients of the interpolated impulse response, there is no necessity to linearly interpolate an entire truncated impulse response sequence.

Computer simulations were utilized to compare the performance of the method of this invention with two other LPC interpolation methods using direct form prediction coefficients and PARCOR coefficients, respectively, as interpolation parameters. A speech coder utilizing this invention was configured at bit-rates of 4800 and 8000 bit per second (bps) respectively. At 8000 bps, almost identical performance, both subjectively and objectively, was obtained when using the direct form prediction coefficients and when using impulse response for interpolation. However, at 4800 bps, the coder utilizing this invention outperforms the other two interpolation methods. Therefore, the method of this invention not only offers a significant computational advantage over other typical interpolation methods, but also improves speech quality.

Further, when the impulse response of the LPC-SF is utilized, a codevector filtered by the interpolated synthesis filter is simply equal to the linear interpolation of the two codevectors filtered by the previous and current uninterpolated synthesis filters allowing a fast codebook search. The second embodiment of LPC interpolation methods thus provides a fast codebook search method, as is illustrated below. Where p, K, N, and $N_s$ are used to represent the LPC predictor order, vector length, excitation codebook size, and number of subpartitions per partition, respectively, the following table gives a comparison of codebook search complexities of using the fast codebook search method and a conventional algorithm.

| | COMPLEXITY (OPERATIONS/PARTITION) | |
|---|---|---|
| TASK | Conventional | Fast Codebook Search |
| Filtering codevectors | $pkNN_s$ | $pKN$ |
| Computing energies | $KNN_s$ | $2KN + 3N(N_s - 1)$ |
| Computing dot products | $KNN_s$ | $KNN_s + \frac{K(K+1)}{2}(N_s - 1)$ |
| Total | $(p + 2)KNN_s$ | $(p + 2 + N_s)KN + 3N(N_s - 1) + \frac{K(K+1)}{2}(N_s - 1)$ |

For example, where p, K, N, and $N_s$ equal 10, 40, 1024, and 4, respectively (with a partition size of 160 samples and a sampling frequency of 8 kHz), a total of major computations for a conventional codebook search is of the order of 98.3 MIPS (Million Instructions Per Second), but only on the order of 33.3 MIPS for a fast codebook search, yielding substantially a 66 percent complexity reduction. When combined with other efficient coding schemes, the method and hardware implementation of the present invention provide for substantial reduction in computational cost for CELP-type coders, provide improved speech coder performance, and maintain a reasonably low encoding complexity.

Thus, the second embodiment is a preferred embodiment since less computation is required, codebook searching complexity is minimized, and partition boundary sampling discontinuities are smoothed, thereby providing improved synthesized signal vectors for reconstructing input signals.

I claim:

1. A method for reconstructing a signal that has been partitioned into successive time interval partitions, each time interval signal partition having a representative input reference signal with a set of vectors, and having at least a first representative electrical signal for each representative input reference signal of each time interval signal partition, the method utilizing at least a codebook unit having at least a codebook memory, a synthesis unit having at least a first synthesis filter, a combiner, and a perceptual weighting unit having at least a first perceptual weighting filter, for utilizing the electrical signals of the representative input reference signals to at least generate a related set of synthesized signal vectors for reconstructing the signal, the method comprising the steps of:

(1A) utilizing the at least first representative electrical signal for each representative input reference signal for a time signal partition to obtain a set of uninterpolated parameters for the at least first synthesis filter;

(1B) utilizing the at least first synthesis filter to obtain the corresponding impulse response representation, and interpolating the impulse responses of each adjacent time signal partition and of a current time signal partition immediately thereafter to provide a set of interpolated synthesis filters for desired subpartitions; and utilizing the interpolated synthesis filters to provide a corresponding set of interpolated perceptual weighting filters for desired subpartitions; such that smooth transitions of the synthesis filter and the perceptual weighting filter between each pair of adjacent partitions are obtained;

(1C) utilizing the set of input reference signal vectors, the related set of interpolated synthesis filters and the related set of interpolated perceptual weighting filters for the current time signal partition to select the corresponding set of optimal excitation codevectors from the at least first codebook memory, further implementing the following steps for each desired input reference signal vector:

(1C1) providing a particular excitation codevector which is associated with a particular index from the at least first codebook memory, the codebook memory having a set of excitation codevectors stored therein responsive to the representative input vectors;

(1C2) inputting the particular excitation codevector into the corresponding interpolated synthesis filter to produce the synthesized signal vector;

(1C3) subtracting the synthesized signal vector from the input reference signal vector related thereto to obtain a corresponding reconstruction error vector;

(1C4) inputting the reconstruction error vector into the corresponding interpolated perceptual weighting unit to determine a corresponding perceptually weighted squared error;

(1C5) determining and storing index of codevector having the perceptually weighted squared error smaller than all other errors produced by other codevectors;

(1C6) repeating the steps (1C1), (1C2), (1C3), (1C4), and (1C5) for every excitation codevector in the codebook memory and implementing these steps utilizing a fast codebook search method, to determine an optimal excitation codevector for producing the minimum weighted squared error among all excitation codevectors for the related input reference signal vector; and (D) successively inputting the set of optimal excitation codevectors into the corresponding set of interpolated synthesis filters to produce the related set of synthesized signal vectors for the given input reference signal for reconstructing the input signal.

2. The method of claim 1, wherein the signal is a speech waveform.

3. The method of claim 1, wherein the at least first synthesis filter is at least a first time-varying linear predictive coding synthesis filter (LPC-SF).

4. The method of claim 3, wherein the at least first LPC-SF has a transfer function substantially of a form:

$$H(z) = \frac{1}{1 - \sum_{i=1}^{p} a_i z^{-i}},$$

where $a_i$'s, for $i=1,2,\ldots,p$ represent a set of estimated prediction coefficients obtained by analyzing the corresponding time signal partition and p represents a predictor order.

5. The method of claim 4, wherein LPC-SFs (linear predictive coding synthesis filters) of an adjacent time signal partition and of a time partition immediately thereafter are substantially of a form:

$$H^{(j)}(z) = \frac{1}{1 - \sum_{i=1}^{p} a_i^{(j)} z^{-1}},$$

where $a_i^{(j)}$'s, for $i=1, 2, 3, \ldots, p$ and $j=1, 2$ represent a set of prediction coefficients in an adjacent time signal partition when $j=1$ and of a current time signal partition immediately thereafter when $j=2$, respectively, p represents a predictor order such that an impulse response for the transfer function $H^{(j)}(z)$ is substantially of a form $$h^{(j)}(n) = \partial(n) + \sum_{i=1}^{p} a_i^{(j)} h^{(j)}(n-i),$$

where $\partial(n)$ is a unit sample function, and such that the impulse response of the at least first synthesis filter at an m-th subpartition of a current time partition obtained through linear interpolation of $h^{(1)}(n)$ and $h^{(2)}(n)$ respectively, denoted below as $h_m(n)$, is substantially of a form:

$$h_m(n) = \alpha_m h^{(1)}(n) + \beta_m h^{(2)}(n),$$

where $\beta_m = 1 - \alpha_m$ and $0 < \alpha_m < 1$, where a different $\alpha_m$ is utilized for each subpartition, thereby providing a transfer function of the interpolated synthesis filter substantially of a form:

$$H_m(z) = \alpha_m H^{(1)}(z) + \beta_m H^{(2)}(z) = \frac{A'_m(z)}{A^{(1)}(z)A^{(2)}(z)},$$

$$\text{where } A'_m(z) = 1 - \sum_{i=1}^{p} (\beta_m a_i^{(1)} + \alpha_m a_i^{(2)}) z^{-i}$$

$$\text{and } A^{(j)}(z) = 1 - \sum_{i=1}^{p} a_i^{(j)} z^{-i} \text{ for } j = 1,2,$$

wherein the perceptual weighting filter at the m-th subpartition of a current time interval signal partition has a transfer function of a form:

$$W_m(z) = \frac{A^{(1)}(z)A^{(2)}(z)}{A'_m(z)} H_m(z/\gamma),$$

where $\gamma$ is typically selected to be substantially 0.8.

6. The method of claim 5, wherein the interpolated synthesis filter is approximated by an all pole filter whose parameters are utilized in the LPC synthesis filter and in the perceptual weighting filter for interpolating subpartitions, wherein the all pole filter parameters are obtained utilizing the steps of:

truncating interpolated impulse samples:

estimating a first p+1 autocorrelation coefficients using the truncated interpolated impulse response samples; and converting the autocorrelation coefficients to direct form prediction coefficients using a recursion algorithm.

7. The method of claim 6, wherein the estimated autocorrelation coefficients at the m-th subpartition can be expressed as:

$$\hat{R}_m(k) = \sum_n h_m(n) h_m(n+k)$$

for $k=0,1,\ldots,p$ and the summation is over all available partition impulse responses, such that $$\hat{R}_m(k) = \alpha_m^2 \hat{R}^{(1)}(k) + \beta_m^2 \hat{R}^{(2)}(k) + \alpha_m \beta_m (\hat{R}^{(12)}(k) + \hat{R}^{(21)}(k))$$

where $$\hat{R}^{(j)}(k) = \sum_n h^{(j)}(n) h^{(j)}(n+k) \text{ for } k = 0,1,\ldots,p \text{ and } j = 1,2,$$

are autocorrelation coefficients of uninterpolated impulse response of the adjacent and current partitions, and $$\hat{R}^{(ij)}(k) = \sum_n h^{(i)}(n) h^{(j)}(n+k) \text{ for } k = 0,1,\ldots,p$$

and $i,j=1,2$ where $i \neq j$, are cross-correlation coefficients between the uninterpolated impulse responses.

8. The method of claim 1, wherein the excitation code vectors are stored in memory.

9. The method of claim 1, wherein the perceptual weighting unit includes at least a first perceptual weighting filter having a transfer function substantially of a form:

$$W(z) = \frac{H(z/\gamma)}{H(z)},$$

where $\gamma$ is typically selected to be substantially 0.8.

10. The method of claim 1, wherein determining an optimal excitation codevector from the codebook memory for each input reference vector includes signal processing every excitation codevector in the codebook memory for each input reference vector, then determining the optimal excitation codevector of those codevectors processed.

11. The method of claim 1, wherein the fast codebook search method further includes utilizing a simplified method to obtain the perceptually weighted squared error between an input signal vector and a related synthesized codevector utilizing an i-th excitation codevector, denoting this error by $E_i$, such that:

$$E_i = ||x||^2 - \frac{A_i^2}{B_i},$$

where x represents an input target vector at a subpartition that is substantially equal to an input reference signal vector at a subpartition filtered by a corresponding interpolated weighting filter with a zero-input response of a corresponding interpolated weighted LPC-SF (linear predictive coding synthesis filter) subtracted from it, $A_i$ represents a dot product of the vector x and an i-th filtered codevector $y_{i,m}$ at an m-th subpartition, and $B_i$ represents the squared norm of the vector $y_{i,m}$.

12. The method of claim 11, wherein the corresponding interpolated weighted LPC-SF has a transfer function of $H_m(z/\gamma)$, such that:

$$H_m(z/\gamma) = \frac{1}{1 - \sum_{i=1}^{p} \gamma^m a_{i,m} z^{-1}},$$

where for an m-th subpartition, $\gamma$ is typically selected to be 0.8, and $a_{i,m}$, for $i=1,2,\ldots p$, such that p is a predictor order, represent the parameters of corresponding interpolated LPC-SF, the impulse response of $H_m(z/\gamma)$, $h_{wm}(n)$, is substantially equal to:

$$h_{wm}(n)=\gamma^n h_m(n),$$

and where $h_m(n)$ is an impulse response of corresponding LPC-SF, utilizing a fact that $h_m(n)$ is a linear interpolation of the impulse responses of related previous and current uninterpolated LPC-SFs, $h_{wm}(n)$, at each interpolating subpartition, determined in a fast codebook search as a linear interpolation of two impulse responses of related previous and current uninterpolated weighted LPC-SFs:

$$h_{wm}(n)=\alpha_m h_w^{(1)}(n)+\beta_m h_w^{(2)}(n),$$

where $h_w^{(j)}(n)=\gamma^n h^{(j)}(n)$ for $j=1,2$ are exponentially weighted uninterpolated impulse responses of the previous, when $j=1$, and the current, when $j=2$, LPC synthesis filters, and where $\beta_m=1-\alpha_m$ and $0<\alpha_m<1$, where a different $\alpha_m$ is utilized for each subpartition.

13. The method of claim 12, wherein the filtered codevector $y_{i,m}$ is determined as a convolution of the i-th excitation codevector $c_i$ with the corresponding weighted impulse response $h_{wm}(n)$, the convolution substantially of a form:

$y_{i,m}=F_{wm}c_i$, where $$F_{wm} = \begin{bmatrix} h_{wm}(0) & 0 & 0 & \ldots & 0 \\ h_{wm}(1) & h_{wm}(0) & 0 & \ldots & 0 \\ h_{wm}(2) & h_{wm}(1) & h_{wm}(0) & \ldots & 0 \\ . & . & . & \ldots & . \\ . & . & . & \ldots & . \\ . & . & . & \ldots & . \\ h_{wm}(k-1) & h_{wm}(k-2) & h_{wm}(k-3) & \ldots & h_{wm}(0) \end{bmatrix}$$

and where k represents a dimension of a codevector, further utilizing the fact that $h_{wm}(n)$ is a linear interpolation of the impulse responses of related previous and current uninterpolated weighted LPC-SFs, the filtered codevector $y_{i,m}$ at each interpolating subpartition may be determined as linear interpolation of two codevectors filtered by the related previous and current uninterpolated weighted LPC-SFs:

$$y_{i,m}=\alpha_m y_i^{(1)}+\beta_m y_i^{(2)},$$

and where $y_i^{(j)}=F_w^{(j)}c_i$ for $j=1,2$ and where matrices $F_w^{(1)}$ and $F_w^{(2)}$ have a same format as the matrix $F_{wm}$, but with different elements $h_w^{(1)}(n)$ and $h_w^{(2)}(n)$, respectively.

14. The method of claim 11, wherein the squared norm $B_i$ at each interpolating subpartition is a weighted sum of a squared norm of a filtered codevector $y_i^{(1)}$, the squared norm of the filtered codevector $y_i^{(2)}$, and a dot product of those two filtered codevectors, substantially of a form:

$$B_i=\alpha_m^2||y_i^{(1)}||^2+\beta_m^2||y_i^{(2)}||^2+2\alpha_m\beta_m<y_i^{(1)}\cdot y_i^{(2)}>,$$

where $\beta_m=1-\alpha_m$ and $0<\alpha_m<1$, where a different $\alpha_m$ is utilized for each subpartition.

15. The method of claim 11, wherein determination of the dot product $A_i$ for each interpolating subpartition comprises two steps:

16A) backward filtering such that $z=F^t_{wm}x$ wherein $$F_{wm} = \begin{bmatrix} h_{wm}(0) & 0 & 0 & \ldots & 0 \\ h_{wm}(1) & h_{wm}(0) & 0 & \ldots & 0 \\ h_{wm}(2) & h_{wm}(1) & h_{wm}(0) & \ldots & 0 \\ . & . & . & \ldots & . \\ . & . & . & \ldots & . \\ . & . & . & \ldots & . \\ h_{wm}(k-1) & h_{wm}(k-2) & h_{wm}(k-3) & \ldots & h_{wm}(0) \end{bmatrix}$$

and where k represents a dimension of a codevector; and where t represents a transpose operator; and 16B) forming a dot product such that:

$$A_i=<z\cdot c_i>,$$

where $c_i$ is the ith excitation codevector.

16. The method of claim 1, further including, after step 1C1, multiplying the particular excitation codevector by an excitation gain factor to provide correlation with an energy of the representative electrical signal for each representative input reference signal vector.

17. A method for reconstructing a speech signal pattern in a digital speech coder, the signal being partitioned into successive time intervals, each time interval signal partition having a representative input reference signal with a set of vectors, and having at least a first representative electrical signal for each representative input reference signal of each time interval signal partition, the method utilizing at least a codebook unit having at least a codebook memory, a gain adjuster where selected, a synthesis unit having at least a first synthesis filter, a combiner, and a perceptual weighting unit having at least a first perceptual weighting filter, for utilizing the electrical signals of the representative input reference signals to at least generate a related set of synthesized signal vectors for reconstructing the signal, the method comprising the steps of:

(17A) utilizing the at least first representative electrical signal for each representative input reference signal for a time signal partition to obtain a set of uninterpolated parameters for the at least first synthesis filter;

(17B) utilizing the at least first synthesis filter to obtain the corresponding impulse response representation, and interpolating the impulse responses of each adjacent time signal partition and of a time signal partition immediately thereafter to provide a set of interpolated synthesis filters for desired subpartitions; and utilizing the interpolated synthesis filters to provide a corresponding set of interpolated perceptual weighting filters for desired subpartitions; such that smooth transitions of the synthesis filter and the perceptual weighting filter between each pair of adjacent partitions are obtained;

(17C) utilizing the set of input reference signal vectors, the related set of interpolated synthesis filters and the related set of interpolated perceptual weighting filters for the current time signal partition to select the corresponding set of optimal excitation codevectors from the at least first codebook memory, further implementing the following steps for each desired input reference signal vector:

(17C1) providing a particular excitation codevector which is associated with a particular index from the at least first codebook memory, the codebook memory having a set of excitation codevectors stored therein responsive to the representative input vectors;

(17C2) inputting the particular excitation codevector into the corresponding interpolated synthesis filter to produce the synthesized signal vector;

(17C3) subtracting the synthesized signal vector from the input reference signal vector related thereto to obtain a corresponding reconstruction error vector;

(17C4) inputting the reconstruction error vector into the corresponding interpolated perceptual weighting unit to determine a corresponding perceptually weighted squared error;

(17C5) determining and storing index of codevector having the perceptually weighted squared error smaller than all other errors produced by other codevectors;

(17C6) repeating the steps (17C1), (17C2), (17C3), (17C4), and (17C5), for every excitation codevector in the codebook memory and implementing these steps utilizing a fast codebook search method, to determine an optimal excitation codevector for producing the minimum weighted squared error among all excitation codevectors for the related input reference signal vector; and (D) successively inputting the set of optimal excitation codevectors into the corresponding set of interpolated synthesis filters to produce the related set of synthesized signal vectors for the given input reference signal for reconstructing the input signal.

18. The method of claim 17, wherein the signal is a speech waveform.

19. The method of claim 17, wherein the at least first synthesis filter is at least a first time-varying linear predictive coding synthesis filter (LPC-SF).

20. The method of claim 19, wherein the at least first LPC-SF has a transfer function substantially of a form:

$$H(z) = \frac{1}{1 - \sum_{i=1}^{p} a_i z^{-1}},$$

where $a_i$'s, for $i=1,2,\ldots,p$ represent a set of estimated prediction coefficients obtained by analyzing the corresponding time signal partition and p represents a predictor order.

21. The method of claim 20, wherein the interpolated synthesis filter is approximated by an all pole filter whose parameters are utilized in the LPC synthesis filter and in the perceptual weighting filter for interpolating subpartitions, wherein the all pole filter parameters are obtained utilizing the steps of:

truncating interpolated impulse samples;

estimating a first $p+1$ autocorrelation coefficients using truncated interpolated impulse response samples; and converting the autocorrelation coefficients to direct form prediction coefficients using a recursion algorithm.

22. The method of claim 21, wherein the estimated autocorrelation coefficients at the m-th subpartition can be expressed as $$\hat{R}_m(k) = \sum_n h_m(n)h_m(n+k)$$

for $k=0,1,\ldots,p$ and the summation is over all available partition impulse responses, such that $$\hat{R}_m(k) = \alpha_m^2\hat{R}^{(1)}(k) + \beta_m^2\hat{R}^{(2)}(k) + \alpha_m\beta_m(\hat{R}^{(12)}(k) + \hat{R}^{(21)}(k))$$

where $$\hat{R}^{(j)}(k) = \sum_n h^{(j)}(n)h^{(j)}(n+k) \text{ for } k = 0,1,\ldots,p \text{ and } j = 1,2,$$

are autocorrelation coefficients of uninterpolated impulse response of the adjacent and current partitions, and $$\hat{R}^{(ij)}(k) = \sum_n h^{(i)}(n)h^{(j)}(n+k) \text{ for } k = 0,1,\ldots,p$$

and $i,j=1,2$ where $i \neq j$, are cross-correlation coefficients between the uninterpolated impulse responses.

23. The method of claim 17, wherein the LPC-SFs of a adjacent time signal partition and of a time partition immediately thereafter are substantially of a form:

$$H^{(j)}(z) = \frac{1}{1 - \sum_{i=1}^{p} a_i^{(j)} z^{-1}},$$

where $a_i^{(j)}$'s, for $i=1, 2, 3, \ldots, p$ and $j=1,2$ represent a set of prediction coefficients in an adjacent time signal partition when $j=1$ and of a current time signal partition immediately thereafter when $j=2$, respectively, p represents a predictor order such that an impulse response for the transfer function $H^{(j)}(z)$ is substantially of a form $$h^{(j)}(n) = \partial(n) + \sum_{i=1}^{p} a_i^{(j)} h^{(j)}(n-i),$$

where $\partial(n)$ is a unit sample function, and such that the impulse response of the at least first synthesis filter at an m-th subpartition of a current time partition obtained through linear interpolation of $h^{(1)}(n)$ and $h^{(2)}(n)$ respectively, denoted below as $h_m(n)$, is substantially of a form:

$$h_m(n) = \alpha_m h^{(1)}(n) + \beta_m h^{(2)}(n),$$

where $\beta_m = 1 - \alpha_m$ and $0 < \alpha_m < 1$, where a different $\alpha_m$ is utilized for each subpartition, thereby providing a transfer function of the interpolated synthesis filter substantially of a form:

$$H_m(z) = \alpha_m H^{(1)}(z) + \beta_m H^{(2)}(z) = \frac{A'_m(z)}{A^{(1)}(z)A^{(2)}(z)},$$

$$\text{where } A'_m(z) = 1 - \sum_{i=1}^{p} (\beta_m a_i^{(1)} + \alpha_m a_i^{(2)}) z^{-i}$$

$$\text{and } A^{(j)}(z) = 1 - \sum_{i=1}^{p} a_i^{(j)} z^{-i} \text{ for } j = 1,2,$$

wherein the perceptual weighting filter at the m-th subpartition of a current time interval signal partition has a transfer function of the form:

$$W_m(z) = \frac{A^{(1)}(z)A^{(2)}(z)}{A'_m(z)} H_m(z/\gamma),$$

where $\gamma$ is typically selected to be substantially 0.8.

24. The method of claim 17, wherein the excitation code vectors are stored in memory.

25. The method of claim 17, wherein the perceptual weighting unit includes at least a first perceptual weighting filter having a transfer function substantially of a form:

$$W(z) = \frac{H(z/\gamma)}{H(z)},$$

where $\gamma$ is typically selected to be substantially 0.8.

26. The method of claim 17, wherein determining an optimal excitation codevector from the codebook memory for each input reference vector includes signal processing every excitation codevector in the codebook memory for each input reference vector, then determining the optimal excitation codevector of those codevectors processed.

27. The method of claim 17, wherein the fast codebook search method further includes utilizing a simplified method to obtain the perceptually weighted squared error between an input signal vector and a related synthesized codevector utilizing an i-th excitation codevector, denoting this error by $E_i$, such that:

$$E_i = ||x||^2 - \frac{A_i^2}{B_i},$$

where x represents an input target vector at a subpartition that is substantially equal to an input reference signal vector at a subpartition filtered by a corresponding interpolated weighting filter with a zero-input response of a corresponding interpolated weighted LPC-SF subtracted from it, $A_i$ represents a dot product of the vector x and an i-th filtered codevector $y_{i,m}$ at an m-th subpartition, and $B_i$ represents the squared norm of the vector $y_{i,m}$.

28. The method of claim 27, wherein the corresponding interpolated weighted LPC-SF has a transfer function of $H_m(z/\gamma)$, such that:

$$H_m(z/\gamma) = \frac{1}{1 - \sum_{i=1}^{p} \gamma^m a_{i,m} z^{-i}},$$

where for an m-th subpartition, $\gamma$ is typically selected to be 0.8, and $a_{i,m}$, for $i = 1,2, \ldots p$, such that p is a predictor order, represent the parameters of corresponding interpolated LPC-SF, the impulse response of $H_m(z/\gamma)$, $h_{wm}(n)$, is substantially equal to:

$$h_{wm}(n) = \gamma^n h_m(n),$$

and where $h_m(n)$ is an impulse response of corresponding LPC-SF, utilizing a fact that $h_m(n)$ is a linear interpolation of the impulse responses of related previous and current uninterpolated LPC-SFs, $h_{wm}(n)$, at each interpolating subpartition, determined in a fast codebook search as a linear interpolation of two impulse responses of related previous and current uninterpolated weighted LPC-SFs:

$$h_{wm}(n) = \alpha_m h_w^{(1)}(n) + \beta_m h_w^{(2)}(n),$$

where $h_w^{(j)}(n) = \gamma^n h^{(j)}(n)$ for $j = 1,2$ are exponentially weighted uninterpolated impulse responses of the previous, when $j = 1$, and the current, when $j = 2$, LPC synthesis filters, and where $\beta_m = 1 - \alpha_m$ and $0 < \alpha_m < 1$, where a different $\alpha_m$ is utilized for each subpartition.

29. The method of claim 27, wherein the filtered codevector $y_{i,m}$ is determined as a convolution of the i-th excitation codevector $c_i$ with the corresponding weighted impulse response $h_{wm}(n)$, the convolution substantially of a form:

$y_{i,m} = F_{wm} c_i$, where $$F_{wm} \doteq \begin{bmatrix} h_{wm}(0) & 0 & 0 & \ldots & 0 \\ h_{wm}(1) & h_{wm}(0) & 0 & \ldots & 0 \\ h_{wm}(2) & h_{wm}(1) & h_{wm}(0) & \ldots & 0 \\ \cdot & \cdot & \cdot & \ldots & \cdot \\ \cdot & \cdot & \cdot & \ldots & \cdot \\ \cdot & \cdot & \cdot & \ldots & \cdot \\ h_{wm}(k-1) & h_{wm}(k-2) & h_{wm}(k-3) & \ldots & h_{wm}(0) \end{bmatrix}$$

and where k represents a dimension of a codevector, further utilizing the fact that $h_{wm}(n)$ is a linear interpolation of the impulse responses of related previous and current uninterpolated weighted LPC-SFs, the filtered codevector $y_{i,m}$ at each interpolating subpartition may be determined as linear interpolation of two codevectors filtered by the related previous and current uninterpolated weighted LPC-SFs:

$$y_{i,m}=\alpha_m y_i^{(1)}+\beta_m y_i^{(2)},$$

and where $y_i^{(j)}=F_w^{(j)}c_i$ for $j=1,2$ and where matrices $F_w^{(1)}$ and $F_w^{(2)}$ have a same format as the matrix $F_{wm}$, but with different elements $h_w^{(1)}(n)$ and $h_w^{(2)}(n)$, respectively.

30. The method of claim 27, wherein the squared norm $B_i$ at each interpolating subpartition is a weighted sum of a squared norm of a filtered codevector $y_i^{(1)}$, a squared norm of the filtered codevector $y_i^{(2)}$, and a dot product of those two filtered codevectors, substantially being of a form:

$$B_i=\alpha_m^2||y_i^{(1)}||^2+\beta_m^2||y_i^{(2)}||^2+2\alpha_m\beta_m<y_i^{(1)}\cdot y_i^{(2)}>,$$

where $\beta_m=1-\alpha_m$ and $0<\alpha_m<1$, where a different $\alpha_m$ is utilized for each subpartition.

31. The method of claim 27, wherein determination of the dot product $A_i$ for each interpolating subpartition comprises two steps:

32A) backward filtering such that $z=F^t_{wm}x$ wherein $$F_{wm}=\begin{bmatrix} h_{wm}(0) & 0 & 0 & \dots & 0 \\ h_{wm}(1) & h_{wm}(0) & 0 & \dots & 0 \\ h_{wm}(2) & h_{wm}(1) & h_{wm}(0) & \dots & 0 \\ . & . & . & \dots & . \\ . & . & . & \dots & . \\ . & . & . & \dots & . \\ h_{wm}(k-1) & h_{wm}(k-2) & h_{wm}(k-3) & \dots & h_{wm}(0) \end{bmatrix}$$

and where k represents a dimension of a codevector; and where t represents a transpose operator; and 32B) forming a dot product such that:

$$A_i=<z\cdot c_i>,$$

where $c_i$ is the ith excitation codevector.

32. The method of claim 17, further including, after step 17C1, multiplying the particular excitation codevector by an excitation gain factor to provide correlation with an energy of the representative electrical signal for each representative input reference signal vector.

33. A device for reconstructing a signal, the signal being partitioned into successive time intervals, each time interval signal partition having a representative input reference signal with a set of vectors, and having at least a first representative electrical signal for each representative input reference signal of each time interval signal partition, for utilizing the electrical signals of the representative input reference signals to at least generate a related set of synthesized signal vectors for reconstructing the signal, the device comprising at least:

(33A) a first synthesis unit, responsive to the at least first representative electrical signal for each representative input reference signal, for utilizing the at least first representative electrical signal for each representative input reference signal for a time signal partition to obtain a set of uninterpolated parameters for the at least first synthesis filter and the impulse response of this synthesis filter, and for interpolating the impulse responses of each adjacent time signal partition and of a current time signal partition immediately thereafter to provide a set of interpolated synthesis filters for desired subpartitions; and utilizing the interpolated synthesis filters to provide a corresponding set of interpolated perceptual weighting filters to at least a first perceptual weighting unit for desired subpartitions such that the at least first perceptual weighting unit provides at least a first perceptually weighted squared error and such that smooth transitions of the synthesis filter and the perceptual weighting filter between each pair of adjacent partitions are obtained;

(33B) a codebook unit, responsive to the set of input reference signal vectors, the related set of interpolated synthesis filters and the related set of interpolated perceptual weighting filters for the current time signal partition, for selecting the corresponding set of optimal excitation codevectors from the at least first codebook memory for each desired input reference signal vector, further comprising at least:

(33B1) a codebook memory, for providing a particular excitation codevector which is associated with a particular index from the at least first codebook memory, the codebook memory having a set of excitation codevectors stored therein responsive to the representative input vectors;

(33B2) an interpolated synthesis filter having a transfer function, responsive to the particular excitation codevector for producing a synthesized signal vector;

(33B3) a combiner, responsive to the synthesized signal vector and to the input reference signal vector related thereto, for subtracting the synthesized signal vector from the input reference signal vector related thereto to obtain a corresponding reconstruction error vector;

(33B4) an interpolated perceptual weighting unit, responsive to the corresponding reconstruction error vector and to the interpolated synthesis filter transfer function, for determining a corresponding perceptually weighted squared error;

(33B5) a selector, responsive to the corresponding perceptually weighted squared error for determining and storing an index of a codevector having the perceptually weighted squared error smaller than all other errors produced by other codevectors;

(33B6) repetition means, responsive to the number of excitation codevectors in the codebook memory, for repeating the steps (33B1), (33B2), (33B3), (33B4), and (33B5) for every excitation codevector in the codebook memory and for implementing these steps utilizing a fast codebook search method, to determine an optimal excitation codevector for producing the minimum weighted squared error among all excitation codevectors for the related input reference signal vector; and (33C) codebook unit control means, responsive to the set of optimal excitation codevectors for successively inputting the set of optimal excitation codevectors into the corresponding set of interpolated synthesis filters to produce the related set of synthesized signal vectors for the given input reference signal for reconstructing the input signal.

34. The device of claim 33, wherein the signal is a speech waveform.

35. The device of claim 33, wherein the at least first synthesis filter is at least a first time-varying linear predictive coding synthesis filter (LPC-SF).

36. The device of claim 35, wherein the at least first LPC-SF has a transfer function substantially of a form:

$$H(z) = \frac{1}{1 - \sum_{i=1}^{p} a_i z^{-i}},$$

where $a_i$'s, for $i=1,2,\ldots,p$ represent a set of estimated prediction coefficients obtained by analyzing the corresponding time signal partition and p represents a predictor order.

37. The device of claim 33, wherein the LPC-SFs of a adjacent time signal partition and of a time partition immediately thereafter are substantially of a form:

$$H^{(j)}(z) = \frac{1}{1 - \sum_{i=1}^{p} a_i^{(j)} z^{-i}},$$

where $a_i^{(j)}$'s, for $i=1, 2, 3, \ldots, p$ and $j=1,2$ represent a set of prediction coefficients in a adjacent time signal partition when $j=1$ and of a current time signal partition immediately thereafter when $j=2$, respectively, p represents a predictor order such that an impulse response for the transfer function $H^{(j)}(z)$ is substantially of a form $$h^{(j)}(n) = \partial(n) + \sum_{i=1}^{p} a_i^{(j)} h^{(j)}(n-i),$$

where $\partial(n)$ is a unit sample function, and such that the impulse response of the at least first synthesis filter at an m-th subpartition of a current time partition obtained through linear interpolation of $h^{(1)}(n)$ and $h^{(2)}(n)$ respectively, denoted below as $h_m(n)$, is substantially of a form:

$$h_m(n) = \alpha_m h^{(1)}(n) + \beta_m h^{(2)}(n),$$

where $\beta_m = 1 - \alpha_m$ and $0 < \alpha_m < 1$, where a different $\alpha_m$ is utilized for each subpartition, thereby providing a transfer function of the interpolated synthesis filter substantially of a form:

$$H_m(z) = \alpha_m H^{(1)}(z) + \beta_m H^{(2)}(z) = \frac{A'_m(z)}{A^{(1)}(z)A^{(2)}(z)}, \text{ where}$$

$$A'_m(z) = 1 - \sum_{i=1}^{p} (\beta_m a_i^{(1)} + \alpha_m a_i^{(2)}) z^{-i} \text{ and}$$

$$A^{(j)}(z) = 1 - \sum_{i=1}^{p} a_i^{(j)} z^{-i} \text{ for } j = 1,2,$$

wherein the perceptual weighting filter at the m-th subpartition of a current time interval signal partition has a transfer function of the form:

$$W_m(z) = \frac{A^{(1)}(z)A^{(2)}(z)}{A'_m(z)} H_m(z/\gamma),$$

where $\gamma$ is typically selected to be substantially 0.8.

38. The device of claim 37, wherein the interpolated synthesis filter is approximated by an all pole filter whose parameters are utilized in the LPC synthesis filter and in the perceptual weighting filter for interpolating subpartitions, wherein the all pole filter parameters are obtained utilizing at least:

estimating means, responsive to interpolated impulse response samples, for truncating interpolated impulse samples and estimating a first $p+1$ autocorrelation coefficients using truncated interpolated impulse response samples; and converting means, responsive to the estimated autocorrelation coefficients, for converting the autocorrelation coefficients to direct form prediction coefficients using a recursion algorithm.

39. The device of claim 38, wherein the estimated autocorrelation coefficients at the m-th subpartition can be expressed as:

$$\hat{R}_m(k) = \sum_n h_m(n) h_m(n+k)$$

for $k=0,1,\ldots,p$ and the summation is over all available partition impulse responses, such that $$\hat{R}_m(k) = \alpha_m^2 \hat{R}^{(1)}(k) + \beta_m^2 \hat{R}^{(2)}(k) + \alpha_m \beta_m (\hat{R}^{(12)}(k) + \hat{R}^{(21)}(k)) \text{ where}$$

$$\hat{R}^{(j)}(k) = \sum_n h^{(j)}(n) h^{(j)}(n+k) \text{ for } k = 0,1,\ldots,p \text{ and } j = 1,2,$$

are autocorrelation coefficients of uninterpolated impulse response of the adjacent and current partitions, and $$\hat{R}^{(i,j)}(k) = \sum_n h^{(i)}(n) h^{(j)}(n+k) \text{ for } k = 0,1,\ldots,p$$

and $i,j=1,2$ where $i \neq j$, are cross-correlation coefficients between the uninterpolated impulse responses.

40. The device of claim 33, wherein the excitation code vectors are stored in memory.

41. The device of claim 33, wherein the perceptual weighting unit includes at least a first perceptual weighting filter having a transfer function substantially of a form:

$$W(z) = \frac{H(z/\gamma)}{H(z)},$$

where $\gamma$ is typically selected to be substantially 0.8.

42. The device of claim 33, wherein determining an optimal excitation codevector from the codebook memory for each input reference vector includes signal processing every excitation codevector in the codebook memory for each input reference vector, then determining the optimal excitation codevector of those codevectors processed.

43. The device of claim 33, wherein the fast codebook search device further includes utilizing a simplified method to obtain the perceptually weighted squared error between an input signal vector and a related synthesized codevector utilizing an i-th excitation codevector, denoting this error by $E_i$, such that:

$$E_i = ||x||^2 - \frac{A_i^2}{B_i},$$

where x represents an input target vector at a subpartition that is substantially equal to an input reference signal vector at a subpartition filtered by a corresponding interpolated weighting filter with a zero-input response of a corresponding interpolated weighted LPC-SF subtracted from it, $A_i$ represents a dot product of the vector x and an i-th filtered codevector $y_{i,m}$ at an m-th subpartition, and $B_i$ represents the squared norm of the vector $y_{i,m}$.

44. The device of claim 43, wherein the corresponding interpolated weighted LPC-SF has a transfer function of $H_m(z/\gamma)$, such that:

$$H_m(z/\gamma) = \frac{1}{1 - \sum_{i=1}^{p} \gamma^m a_{i,m} z^{-i}},$$

where for an m-th subpartition, $\gamma$ is typically selected to be 0.8, and $a_{i,m}$, for $i=1,2,\ldots p$, such that p is a predictor order, represent the parameters of corresponding interpolated LPC-SF, the impulse response of $H_m(z/\gamma)$, $h_{wm}(n)$, is substantially equal to:

$$h_{wm}(n)=\gamma^n h_m(n),$$

and where $h_m(n)$ is an impulse response of corresponding LPC-SF, utilizing a fact that $h_m(n)$ is a linear interpolation of the impulse responses of related previous and current uninterpolated LPC-SFs, $h_{wm}(n)$, at each interpolating subpartition, determined in a fast codebook search as a linear interpolation of two impulse responses of related previous and current uninterpolated weighted LPC-SFs:

$$h_{wm}(n)=\alpha_m h_w^{(1)}(n)+\beta_m h_w^{(2)}(n),$$

where $h_w^{(j)}(n)=\gamma^n h^{(j)}(n)$ for $j=1,2$ are exponentially weighted uninterpolated impulse responses of the previous, when $j=1$, and the current, when $j=2$, LPC synthesis filters, and where $\beta_m=1-\alpha_m$ and $0<\alpha_m<1$, where a different $\alpha_m$ is utilized for each subpartition.

45. The device of claim 43, wherein the filtered codevector $y_{i,m}$ is determined as a convolution of the i-th excitation codevector $c_i$ with the corresponding weighted impulse response $h_{wm}(n)$, the convolution being:

$y_{i,m}=F_{wm}c_i$, where $$F_{wm} = \begin{bmatrix} h_{wm}(0) & 0 & 0 & \ldots & 0 \\ h_{wm}(1) & h_{wm}(0) & 0 & \ldots & 0 \\ h_{wm}(2) & h_{wm}(1) & h_{wm}(0) & \ldots & 0 \\ . & . & . & \ldots & . \\ . & . & . & \ldots & . \\ . & . & . & \ldots & . \\ h_{wm}(k-1) & h_{wm}(k-2) & h_{wm}(k-3) & \ldots & h_{wm}(0) \end{bmatrix}$$

and where k represents a dimension of a codevector, further utilizing the fact that $h_{wm}(n)$ is a linear interpolation of the impulse responses of related previous and current uninterpolated weighted LPC-SFs, the filtered codevector $y_{i,m}$ at each interpolating subpartition may be determined as linear interpolation of two codevectors filtered by the related previous and current uninterpolated weighted LPC-SFs:

$$y_{i,m}=\alpha_m y_i^{(1)}+\beta_m y_i^{(2)},$$

and where $y_i^{(j)}=F_w^{(j)}c_i$ for $j=1,2$ and where matrices $F_w^{(1)}$ and $F_w^{(2)}$ have a same format as the matrix $F_{wm}$, but with different elements $h_w^{(1)}(n)$ and $h_w^{(2)}(n)$, respectively.

46. The device of claim 43, further including a second determiner, responsive to the squared norm of a filtered codevector $y_i^{(1)}$, the squared norm of the filtered codevector $y_i^{(2)}$, and a dot product of those two filtered codevectors, for determining the squared norm $B_i$ at each interpolating subpartition, a weighted sum of a squared norm of a filtered codevector $y_i^{(1)}$, a squared norm of the filtered codevector $y_i^{(2)}$, and a dot product of those two filtered codevectors, substantially being of a form:

$$B_i=\alpha_m^2||y_i^{(1)}||^2+\beta_m^2||y_i^{(2)}||^2+2\alpha_m\beta_m<y_i^{(1)},y_i^{(2)}>,$$

where $\beta_m=1-\alpha_m$ and $0<\alpha_m<1$, where a different $\alpha_m$ is utilized for each subpartition.

47. The device of claim 43, further including a first determiner for determination of the dot product $A_i$ for each interpolating subpartition comprising at least:

48A) a backward filter, responsive to an input vector x and to the matrix $F_{wm}$, wherein $$F_{wm} = \begin{bmatrix} h_{wm}(0) & 0 & 0 & \ldots & 0 \\ h_{wm}(1) & h_{wm}(0) & 0 & \ldots & 0 \\ h_{wm}(2) & h_{wm}(1) & h_{wm}(0) & \ldots & 0 \\ . & . & . & \ldots & . \\ . & . & . & \ldots & . \\ . & . & . & \ldots & . \\ h_{wm}(k-1) & h_{wm}(k-2) & h_{wm}(k-3) & \ldots & h_{wm}(0) \end{bmatrix}$$

and where k represents a dimension of a codevector, for determining a vector z such that $$z=F^t_{wm}x; \text{ and}$$

where t represents a transpose operator; and 48B) a dot product determiner, responsive to the vector z and to the m-th excitation codevector, for forming a dot product such that:

$$A_i=<z\cdot c_i>,$$

where $c_i$ is the ith excitation codevector.

48. The device of claim 33, further including a gain adjuster, responsive to the particular excitation codevector, for multiplying the particular excitation codevector (provided by the codebook memory) by an excitation gain factor to provide correlation with an energy of the representative electrical signal for each representative input reference signal vector.

49. A device for reconstructing a speech signal in a digital speech coder, the signal being partitioned into successive time intervals, each time interval signal partition having a representative input reference signal with a set of vectors, and having at least a first representative electrical signal for each representative input reference signal of each time interval signal partition, for utilizing the electrical signals of the representative input reference signals to at least generate a related set of synthesized signal vectors for reconstructing the signal, the device comprising at least:

(49A) a first synthesis unit, responsive to the at least first representative electrical signal for each representative input reference signal, for utilizing the at least first representative electrical signal for each representative input reference signal for a time signal partition to obtain a set of uninterpolated parameters for the at least first synthesis filter and the impulse response of this synthesis filter, and for interpolating the impulse responses of each adjacent time signal partition and of a current time signal partition immediately thereafter to provide a set of interpolated synthesis filters for desired subpartitions; and utilizing the interpolated synthesis filters to provide a corresponding set of interpolated perceptual weighting filters to at least a first perceptual weighting unit for desired subpartitions such that the at least first perceptual weighting unit provides at least a first perceptually weighted squared error and such that smooth transitions of the synthesis filter and the perceptual weighting filter between each pair of adjacent partitions are obtained;

(49B) a codebook unit, responsive to the set of input reference signal vectors, the related set of interpolated synthesis filters and the related set of interpolated perceptual weighting filters for the current time signal partition, for selecting the corresponding set of optimal excitation codevectors from the at least first codebook memory for each desired input reference signal vector, further comprising at least:

(49B1) a codebook memory, for providing a particular excitation codevector which is associated with a particular index from the at least first codebook memory, the codebook memory having a set of excitation codevectors stored therein responsive to the representative input vectors;

(49B2) an interpolated synthesis filter having a transfer function, responsive to the particular excitation codevector for producing a synthesized signal vector;

(49B3) a combiner, responsive to the synthesized signal vector and to the input reference signal vector related thereto, for subtracting the synthesized signal vector from the input reference signal vector related thereto to obtain a corresponding reconstruction error vector;

(49B4) an interpolated perceptual weighting unit, responsive to the corresponding reconstruction error vector and to the interpolated synthesis filter transfer function, for determining a corresponding perceptually weighted squared error;

(49B5) a selector, responsive to the corresponding perceptually weighted squared error for determining and storing an index of a codevector having the perceptually weighted squared error smaller than all other errors produced by other codevectors;

(49B6) repetition means, responsive to the number of excitation codevectors in the codebook memory, for repeating the steps (49B1), (49B2), (49B3), (49B4), and (49B5) for every excitation codevector in the codebook memory and for implementing these steps utilizing a fast codebook search method, to determine an optimal excitation codevector for producing the minimum weighted squared error among all excitation codevectors for the related input reference signal vector; and (D) codebook unit control means, responsive to the set of optimal excitation codevectors for successively inputting the set of optimal excitation codevectors into the corresponding set of interpolated synthesis filters to produce the related set of synthesized signal vectors for the given input reference signal for reconstructing the input signal.

50. The device of claim 49, wherein the at least first synthesis filter is at least a first time-varying linear predictive coding synthesis filter (LPC-SF).

51. The device of claim 50, wherein the at least first LPC-SF has a transfer function substantially of a form:

$$H(z) = \frac{1}{1 - \sum_{i=1}^{p} a_i z^{-i}},$$

where $a_i$'s, for $i=1,2,\ldots,p$ represent a set of estimated prediction coefficients obtained by analyzing the corresponding time signal partition and p represents a predictor order.

52. The device of claim 50, wherein the LPC-SFs of an adjacent time signal partition and of a time partition immediately thereafter are substantially of a form:

$$H^{(j)}(z) = \frac{1}{1 - \sum_{i=1}^{p} a_i^{(j)} z^{-i}},$$

where $a_i^{(j)}$'s, for $i=1, 2, 3, \ldots, p$ and $j=1, 2$ represent a set of prediction coefficients in an adjacent time signal partition when $j=1$ and of a current time signal partition immediately thereafter when $j=2$, respectively, p represents a predictor order such that an impulse response for the transfer function $H^{(j)}(z)$ is substantially of a form $$h^{(j)}(n) = \partial(n) + \sum_{i=1}^{p} a_i^{(j)} h^{(j)}(n-i),$$

where $\partial(n)$ is a unit sample function, and such that the impulse response of the at least first synthesis filter at an m-th subpartition of a current time partition obtained through linear interpolation of $h^{(1)}(n)$ and $h^{(2)}(n)$ respectively, denoted below as $h_m(n)$, is substantially of a form:

$$h_m(n) = \alpha_m h^{(1)}(n) + \beta_m h^{(2)}(n),$$

where $\beta_m = 1 - \alpha_m$ and $0 < \alpha_m < 1$, where a different $\alpha_m$ is utilized for each subpartition, thereby providing a transfer function of the interpolated synthesis filter substantially of a form:

$$H_m(z) = \alpha_m H^{(1)}(z) + \beta_m H^{(2)}(z) = \frac{A'_m(z)}{A^{(1)}(z) A^{(2)}(z)},$$

where $A'_m(z) = 1 - \sum_{i=1}^{p} (\beta_m a_i^{(1)} + \alpha_m a_i^{(2)}) z^{-i}$ -continued $$\text{and } A^{(j)}(z) = 1 - \sum_{i=1}^{p} a_i^{(j)} z^{-i} \text{ for } j = 1,2,$$

wherein the perceptual weighting filter at the m-th subpartition of a current time interval signal partition has a transfer function of the form:

$$W_m(z) = \frac{A^{(1)}(z)A^{(2)}(z)}{A'_m(z)} H_m(z/\gamma),$$

where $\gamma$ is typically selected to be substantially 0.8.

53. The device of claim 52, wherein the interpolated synthesis filter is approximated by an all pole filter whose parameters are utilized in the LPC synthesis filter and in the perceptual weighting filter for interpolating subpartitions, wherein the all pole filter parameters are obtained utilizing at least:

estimating means, responsive to interpolated impulse response samples, for truncating interpolated impulse samples and estimating a first p+1 autocorrelation coefficients using truncated interpolated impulse response samples; and converting means, responsive to the estimated autocorrelation coefficients, for converting the autocorrelation coefficients to direct form prediction coefficients using a recursion algorithm.

54. The device of claim 53, wherein the estimated autocorrelation coefficients at the m-th subpartition can be expressed as:

$$\hat{R}_m(k) = \sum_n h_m(n)h_m(n+k)$$

for k=0,1, . . . , p and the summation is over all available partition impulse responses, such that $$\hat{R}_m(k) = \alpha_m^2 \hat{R}^{(1)}(k) + \beta_m^2 \hat{R}^{(2)}(k) + \alpha_m\beta_m(\hat{R}^{(12)}(k) + \hat{R}^{(21)}(k))$$

$$\text{where } \hat{R}^{(j)}(k) = \sum_n h^{(j)}(n)h^{(j)}(n+k) \text{ for } k = 0,1,\ldots,p \text{ and } j = 1,2,$$

are autocorrelation coefficients of uninterpolated impulse response of the adjacent and current partitions, and $$\hat{R}^{(ij)}(k) = \sum_n h^{(i)}(n)h^{(j)}(n+k) \text{ for } k = 0,1,\ldots,p$$

and i,j=1,2 where $i \neq j$, are cross-correlation coefficients between the uninterpolated impulse responses.

55. The device of claim 49, wherein the excitation code vectors are stored in memory.

56. The device of claim 49, wherein the perceptual weighting unit includes at least a first perceptual weighting filter having a transfer function substantially of a form:

$$W(z) = \frac{H(z/\gamma)}{H(z)},$$

where $\gamma$ is typically selected to be substantially 0.8.

57. The device of claim 49, wherein determining an optimal excitation codevector from the codebook memory for each input reference vector includes signal processing every excitation codevector in the codebook memory for each input reference vector, then determining the optimal excitation codevector of those codevectors processed.

58. The device of claim 49, wherein the fast codebook search device further includes codebook unit means for utilizing a simplified method to obtain the perceptually weighted squared error between an input signal vector and a related synthesized codevector utilizing an i-th excitation codevector, denoting this error by $E_i$, such that:

$$E_i = ||x||^2 - \frac{A_i^2}{B_i},$$

where x represents an input target vector at a subpartition that is substantially equal to an input reference signal vector at a subpartition filtered by a corresponding interpolated weighting filter with a zero-input response of a corresponding interpolated weighted LPC-SF subtracted from it, $A_i$ represents a dot product of the vector x and an i-th filtered codevector $y_{i,m}$ at an m-th subpartition, and $B_i$ represents the squared norm of the vector $y_{i,m}$.

59. The device of claim 58, wherein the corresponding interpolated weighted LPC-SF has a transfer function of $H_m(z/\gamma)$, such that:

$$H_m(z/\gamma) = \frac{1}{1 - \sum_{i=1}^{p} \gamma^m a_{i,m} z^{-i}},$$

where for an m-th subpartition, $\gamma$ is typically selected to be 0.8, and $a_{i,m}$, for i=1,2, . . . p, such that p is a predictor order, represent the parameters of corresponding interpolated LPC-SF, the impulse response of $H_m(z/\gamma)$, $h_{wm}(n)$, is substantially equal to:

$$h_{wm}(n) = \gamma^n h_m(n),$$

and where $h_m(n)$ is an impulse response of corresponding LPC-SF, utilizing a fact that $h_m(n)$ is a linear interpolation of the impulse responses of related previous and current uninterpolated LPC-SFs, $h_{wm}(n)$, at each interpolating subpartition, determined in a fast codebook search as a linear interpolation of two impulse responses of related previous and current uninterpolated weighted LPC-SFs:

$$h_{wm}(n) = \alpha_m h_w^{(1)}(n) + \beta_m h_w^{(2)}(n),$$

where $h_w^{(j)}(n) = \gamma^n h^{(j)}(n)$ for j=1,2 are exponentially weighted uninterpolated impulse responses of the previous, when j=1, and the current, when j=2, LPC synthesis filters, and where $\beta_m = 1 - \alpha_m$ and $0 < \alpha_m < 1$, where a different $\alpha_m$ is utilized for each subpartition.

60. The device of claim 58, wherein the filtered codevector $y_{i,m}$ is determined as a convolution of the i-th excitation codevector $c_i$ with the corresponding weighted impulse response $h_{wm}(n)$, the convolution substantially of a form:

$y_{i,m} = F_{wm} c_i$, where $$F_{wm} = \begin{bmatrix} h_{wm}(0) & 0 & 0 & \dots 0 \\ h_{wm}(1) & h_{wm}(0) & 0 & \dots 0 \\ h_{wm}(2) & h_{wm}(1) & h_{wm}(0) & \dots 0 \\ \cdot & \cdot & \cdot & \dots \\ \cdot & \cdot & \cdot & \dots \\ \cdot & \cdot & \cdot & \dots \\ h_{wm}(k-1) & h_{wm}(k-2) & h_{wm}(k-3) & \dots h_{wm}(0) \end{bmatrix}$$

and where k represents a dimension of a codevector, further utilizing the fact that $h_{wm}(n)$ is a linear interpolation of the impulse responses of related previous and current uninterpolated weighted LPC-SFs, the filtered codevector $y_{i,m}$ at each interpolating subpartition may be determined as linear interpolation of two codevectors filtered by the related previous and current uninterpolated weighted LPC-SFs:

$$y_{i,m} = \alpha_m y_i^{(1)} + \beta_m y_i^{(2)},$$

and where $y_i^{(j)} = F_w^{(j)} c_i$ for $j = 1,2$ and where matrices $F_w^{(1)}$ and $F_w^{(2)}$ have a same format as the matrix $F_{wm}$, but with different elements $h_w^{(1)}(n)$ and $h_w^{(2)}(n)$, respectively.

61. The device of claim 58, further including a second determiner, responsive to the squared norm of a filtered codevector $y_i^{(1)}$, the squared norm of the filtered codevector $y_i^{(2)}$, and a dot product of those two filtered codevectors, for determining the squared norm $B_i$ at each interpolating subpartition, a weighted sum of a squared norm of a filtered codevector $y_i^{(1)}$, the weighted squared norm of the filtered codevector $y_i^{(2)}$, and a dot product of those two filtered codevectors, substantially being of a form:

$$B_i = \alpha_m^2 ||y_i^{(1)}||^2 + \beta_m^2 ||y_i^{(2)}||^2 + 2\alpha_m\beta_m < y_i^{(1)} \cdot y_i^{(2)} >,$$

where $\beta_m = 1 - \alpha_m$ and $0 < \alpha_m < 1$, where a different $\alpha_m$ is utilized for each subpartition.

62. The device of claim 58, further including a first determiner for determination of the dot product $A_i$ for each interpolating subpartition comprising at least:

63A) a backward filter, responsive to an input vector x and to the matrix $F_{wm}$ wherein $$F_{wm} = \begin{bmatrix} h_{wm}(0) & 0 & 0 & \dots 0 \\ h_{wm}(1) & h_{wm}(0) & 0 & \dots 0 \\ h_{wm}(2) & h_{wm}(1) & h_{wm}(0) & \dots 0 \\ \cdot & \cdot & \cdot & \dots \\ \cdot & \cdot & \cdot & \dots \\ \cdot & \cdot & \cdot & \dots \\ h_{wm}(k-1) & h_{wm}(k-2) & h_{wm}(k-3) & \dots h_{wm}(0) \end{bmatrix}$$

and where k represents a dimension of a codevector, for determining a vector z such that $z = F^t_{wm} x$; and where t represents a transpose operator; and 63B) a dot product determiner, responsive to the vector z and to the m-th excitation codevector, for forming a dot product such that:

$$A_i = < z \cdot c_i >,$$

where $c_i$ is the ith excitation codevector.

63. The device of claim 49, further including a gain adjuster, responsive to the particular excitation codevector provided by the codebook memory, for multiplying the particular excitation codevector by an excitation gain factor to provide correlation with an energy of the representative electrical signal for each representative input reference signal vector.

64. A system for reconstructing a speech signal in a digital speech coder, the signal being partitioned into successive time intervals, each time interval signal partition having a representative input reference signal with a set of vectors, and having at least a first representative electrical signal for each representative input reference signal of each time interval signal partition, for utilizing the electrical signals of the representative input reference signals to at least generate a related set of synthesized signal vectors for reconstructing the signal, the system comprising at least:

(64A) a first synthesis unit, responsive to the at least first representative electrical signal for each representative input reference signal, for utilizing the at least first representative electrical signal for each representative input reference signal for a time signal partition to obtain a set of uninterpolated parameters for the at least first synthesis filter and the impulse response of this synthesis filter, and having a first synthesis filter, the at least first synthesis filter being at least a first time-varying linear predictive coding synthesis filter (LPC-SF) wherein the at least first LPC-SF has a transfer function substantially of a form:

$$H(z) = \frac{1}{1 - \sum_{i=1}^{p} a_i z^{-i}},$$

where $a_i$'s, for $i = 1,2, \dots, p$ represent a set of estimated prediction coefficients obtained by analyzing the corresponding time signal partition and p represents a predictor order, responsive to the set of uninterpolated parameters, for obtaining the corresponding impulse response representation, and interpolating the impulse responses of each adjacent time signal partition and of a current time signal partition immediately thereafter, wherein the LPC-SFs of a adjacent time signal partition and of a time partition immediately thereafter are substantially of a form:

$$H^{(j)}(z) = \frac{1}{1 - \sum_{i=1}^{p} a_i^{(j)} z^{-i}},$$

where $a_i^{(j)}$'s, for $i = 1, 2, 3, \dots, p$ and $j = 1, 2$ represent a set of prediction coefficients in an adjacent time signal partition when $j = 1$ and of a current time signal partition immediately thereafter when $j = 2$, respectively, p represents a predictor order such that an impulse response for the transfer function $H^{(j)}(z)$ is substantially of a form $$h^{(j)}(n) = \partial(n) + \sum_{i=1}^{p} a_i^{(j)} h^{(j)}(n - i),$$

where $\partial(n)$ is a unit sample function, and such that the impulse response of the at least first synthesis filter at an m-th subpartition of a current time partition obtained through linear interpolation of $h^{(1)}(n)$ and $h^{(2)}(n)$ respectively, denoted below as $h_m(n)$, is substantially of a form:

$$h_m(n)=\alpha_m h^{(1)}(n)+\beta_m h^{(2)}(n),$$

where $\beta_m=1-\alpha_m$ and $0<\alpha_m<1$, where a different $\alpha_m$ is utilized for each subpartition, thereby providing a transfer function of an interpolated synthesis filter substantially of a form:

$$H_m(z) = \alpha_m H^{(1)}(z) + \beta_m H^{(2)}(z) = \frac{A'_m(z)}{A^{(1)}(z)A^{(2)}(z)},$$

where $$A'_m(z) = 1 - \sum_{i=1}^{p} (\beta_m a_i^{(1)} + \alpha_m a_i^{(2)}) z^{-i}$$

and $$A^{(j)}(z) = 1 - \sum_{i=1}^{p} a_i^{(j)} z^{-i} \text{ for } j = 1,2,$$

wherein the perceptual weighting filter at the m-th subpartition of a current time interval signal partition has a transfer function of the form:

$$W_m(z) = \frac{A^{(1)}(z)A^{(2)}(z)}{A'_m(z)} H_m(z/\gamma),$$

where $\gamma$ is typically selected to be substantially 0.8, to provide a set of interpolated synthesis filters for desired subpartitions; and utilizing the interpolated synthesis filters, to provide a corresponding set of interpolated perceptual weighting filters to at least a first perceptual weighting unit for desired subpartitions such that the at least first perceptual weighting unit provides at least a first perceptually weighted squared error and such that smooth transitions of the synthesis filter and the perceptual weighting filter between each pair of adjacent partitions are obtained;

(64B) a codebook unit, responsive to the set of input reference signal vectors, the related set of interpolated synthesis filters and the related set of interpolated perceptual weighting filters for the current time signal partition, for selecting the corresponding set of optimal excitation codevectors from the at least first codebook memory for each desired input reference signal vector, further comprising at least:

(64B1) a first codebook memory, for providing a particular excitation codevector which is associated with a particular index from the at least first codebook memory, the codebook memory having a set of excitation codevectors stored therein responsive to the representative input vectors;

(64B2) an interpolated synthesis filter having a transfer function, responsive to the particular excitation codevector for producing a synthesized signal vector;

(64B3) a combiner, responsive to the synthesized signal vector and to the input reference signal vector related thereto, for subtracting the synthesized signal vector from the input reference signal vector related thereto to obtain a corresponding reconstruction error vector;

(64B4) an interpolated perceptual weighting unit, responsive to the corresponding reconstruction error vector and to the interpolated synthesis filter transfer function, for determining a corresponding perceptually weighted squared error;

(64B5) a selector, responsive to the corresponding perceptually weighted squared error for determining and storing an index of a codevector having the perceptually weighted squared error smaller than all other errors produced by other codevectors;

(64B6) repetition means, responsive to the number of excitation codevectors in the codebook memory, for repeating the steps (64B1), (64B2), (64B3), (64B4), and (64B5) for every excitation codevector in the codebook memory and for implementing these steps utilizing a fast codebook search method, to determine an optimal excitation codevector for producing the minimum weighted squared error among all excitation codevectors for the related input reference signal vector; and (C) codebook unit control means, responsive to the set of optimal excitation codevectors for successively inputting the set of optimal excitation codevectors into the corresponding set of interpolated synthesis filters to produce the related set of synthesized signal vectors for the given input reference signal for reconstructing the input signal.

65. The system of claim 64, wherein the synthesis filter is approximated by an all pole synthesis filter that is utilized to provide parameters for interpolating subpartitions in the LPC-SF filter and in the perceptual weighting filter, wherein the all pole synthesis filter parameters are obtained utilizing at least:

estimating means, responsive to interpolated impulse response samples, for truncating interpolated impulse samples and estimating a first p+1 autocorrelation coefficients using truncated interpolated impulse response samples; and converting means, responsive to the estimated autocorrelation coefficients, for converting the autocorrelation coefficients to direct form prediction coefficients using a recursion algorithm.

66. The system of claim 65, wherein the estimated autocorrelation coefficients at the m-th subpartition can be expressed as:

$$\hat{R}_m(k) = \sum_n h_m(n)h_m(n+k)$$

for $k=0,1,\ldots,p$ and the summation is over all available partition impulse responses, such that $$\hat{R}_m(k) = \alpha_m^2\hat{R}^{(1)}(k) + \beta_m^2\hat{R}^{(2)}(k) + \alpha_m\beta_m(\hat{R}^{(12)}(k) + \hat{R}^{(21)}(k))$$

where $$\hat{R}^{(j)}(k) = \sum_n h^{(j)}(n)h^{(j)}(n+k) \text{ for } k = 0,1,\ldots,p \text{ and } j = 1,2,$$

are autocorrelation coefficients of uninterpolated impulse response of the adjacent and current partitions, and $$\hat{R}^{(ij)}(k) = \sum_n h^{(i)}(n)h^{(j)}(n+k) \text{ for } k = 0,1,\ldots,p$$

and i,j=1,2 where i≠j, are cross-correlation coefficients between the uninterpolated impulse responses.

67. The system of claim 64, wherein the excitation code vectors are stored in memory.

68. The system of claim 64, wherein the perceptual weighting unit includes at least a first perceptual weighting filter having a transfer function substantially of a form:

$$W(z) = \frac{H(z/\gamma)}{H(z)},$$

where $\gamma$ is typically selected to be substantially 0.8.

69. The system of claim 64, wherein determining an optimal excitation codevector from the codebook memory for each input reference vector includes signal processing every excitation codevector in the codebook memory for each input reference vector, then determining the optimal excitation codevector of those codevectors processed.

70. The system of claim 64, wherein the fast codebook search system further includes utilizing a simplified method to obtain the perceptually weighted squared error between an input signal vector and a related synthesized codevector utilizing an i-th excitation codevector, denoting this error by $E_i$, such that:

$$E_i = ||x||^2 - \frac{A_i^2}{B_i},$$

where x represents an input target vector at a subpartition that is substantially equal to an input reference signal vector at a subpartition filtered by a corresponding interpolated weighting filter with a zero-input response of a corresponding interpolated weighted LPC-SF subtracted from it, $A_i$ represents a dot product of the vector x and an i-th filtered codevector $y_{i,m}$ at an m-th subpartition, and $B_i$ represents the squared norm of the vector $y_{i,m}$.

71. The system of claim 70, wherein the corresponding interpolated weighted LPC-SF has a transfer function of $H_m(z/\gamma)$, such that:

$$H_m(z/\gamma) = \frac{1}{1 - \sum_{i=1}^{p} \gamma^m a_{i,m} z^{-i}},$$

where for an m-th subpartition, $\gamma$ is typically selected to be 0.8, and $a_{i,m}$, for i=1,2, . . . p, such that p is a predictor order, represent the parameters of corresponding interpolated LPC-SF, the impulse response of $H_m(z/\gamma)$, $h_{wm}(n)$, is substantially equal to:

$$h_{wm}(n) = \gamma^n h_m(n),$$

and where $h_m(n)$ is an impulse response of corresponding LPC-SF, utilizing a fact that $h_m(n)$ is a linear interpolation of the impulse responses of related previous and current uninterpolated LPC-SFs, $h_{wm}(n)$, at each interpolating subpartition, determined in a fast codebook search as a linear interpolation of two impulse responses of related previous and current uninterpolated weighted LPC-SFs:

$$h_{wm}(n) = \alpha_m h_w^{(1)}(n) + \beta_m h_w^{(2)}(n),$$

where $h_w^{(j)}(n) = \gamma^n h^{(j)}(n)$ for j=1,2 are exponentially weighted uninterpolated impulse responses of the previous, when j=1, and the current, when j=2, LPC synthesis filters, and where $\beta_m = 1 - \alpha_m$ and $0 < \alpha_m < 1$, where a different $\alpha_m$ is utilized for each subpartition.

72. The system of claim 70, wherein the filtered codevector $y_{i,m}$ is determined as a convolution of the i-th excitation codevector $c_i$ with the corresponding weighted impulse response $h_{wm}(n)$, the convolution substantially of a form:

$y_{i,m} = F_{wm} c_i$, where $$F_{wm} = \begin{bmatrix} h_{wm}(0) & 0 & 0 & \dots 0 \\ h_{wm}(1) & h_{wm}(0) & 0 & \dots 0 \\ h_{wm}(2) & h_{wm}(1) & h_{wm}(0) & \dots 0 \\ \cdot & \cdot & \cdot & \dots \\ \cdot & \cdot & \cdot & \dots \\ \cdot & \cdot & \cdot & \dots \\ h_{wm}(k-1) & h_{wm}(k-2) & h_{wm}(k-3) & \dots h_{wm}(0) \end{bmatrix}$$

and where k represents a dimension of a codevector, further utilizing the fact that $h_{wm}(n)$ is a linear interpolation of the impulse responses of related previous and current uninterpolated weighted LPC-SFs, the filtered codevector $y_{i,m}$ at each interpolating subpartition may be determined as linear interpolation of two codevectors filtered by the related previous and current uninterpolated weighted LPC-SFs:

$$y_{i,m} = \alpha_m y_i^{(1)} + \beta_m y_i^{(2)},$$

and where $y_i^{(j)} = F_w^{(j)} c_i$ for j=1,2 and where matrices $F_w^{(1)}$ and $F_w^{(2)}$ have a same format as the matrix $F_{wm}$, but with different elements $h_w^{(1)}(n)$ and $h_w^{(2)}(n)$, respectively.

73. The system of claim 70, further including a second determiner, responsive to the squared norm of a filtered codevector $y_i^{(1)}$, the squared norm of the filtered codevector $y_i^{(2)}$, and a dot product of those two filtered codevectors, for determining the squared norm $B_i$ at each interpolating subpartition, a weighted sum of a squared norm of a filtered codevector $y_i^{(1)}$, the squared norm of the filtered codevector $y_i^{(2)}$, and a dot product of those two filtered codevectors, substantially of a form:

$$B_i = \alpha_m^2 ||y_i^{(1)}||^2 + \beta_m^2 ||y_i^{(2)}||^2 + 2\alpha_m\beta_m \langle y_i^{(1)}, y_i^{(2)} \rangle,$$

where $\beta_m = 1 - \alpha_m$ and $0 < \alpha_m < 1$, where a different $\alpha_m$ is utilized for each subpartition.

74. The system of claim 70, further including a first determiner for determination of the dot product $A_i$ for each interpolating subpartition comprising at least:

75A) a backward filter, responsive to an input vector x and to the matrix $F_{wm}$, wherein $$F_{wm} = \begin{bmatrix} h_{wm}(0) & 0 & 0 & \ldots 0 \\ h_{wm}(1) & h_{wm}(0) & 0 & \ldots 0 \\ h_{wm}(2) & h_{wm}(1) & h_{wm}(0) & \ldots 0 \\ \cdot & \cdot & \cdot & \ldots \\ \cdot & \cdot & \cdot & \ldots \\ \cdot & \cdot & \cdot & \ldots \\ h_{wm}(k-1) & h_{wm}(k-2) & h_{wm}(k-3) & \ldots h_{wm}(0) \end{bmatrix}$$

and where k represents a dimension of a codevector, for determining a vector z such that $z = F^t_{wm}x$; and where t represents a transpose operator; and 75B) a dot product determiner, responsive to the vector z and to the m-th excitation codevector, for forming a dot product such that:

$$A_i = \langle z \cdot c_i \rangle,$$

where $c_i$ is the ith excitation codevector.

75. The system of claim 64, further including a gain adjuster, responsive to the particular excitation codevector provided by the codebook memory, for multiplying the particular excitation codevector by an excitation gain factor to provide correlation with an energy of the representative electrical signal for each representative input reference signal vector.

* * * * *

UNITED STATES PATENT AND TRADEMARK OFFICE
CERTIFICATE OF CORRECTION

PATENT NO. : 5,195,168

DATED : March 16, 1993

INVENTOR(S) : Mei Yong

It is certified that error appears in the above-identified patent and that said Letters Patent is hereby corrected as shown below:

In the claims:

At column 15, line 32, "$z^{-1}$" should be --$z^{-i}$--.

At column 17, line 23, "$z^{-1}$" should be --$z^{-i}$--.

At column 17, line 51, "claim 12" should be --claim 11--.

At column 20, line 10, "$z^{-1}$" should be --$z^{-i}$--.

At column 20, line 59, "$z^{-1}$" should be --$z^{-i}$--.

At column 23, line 21, "32A)" should be --31A)--.

At column 23, line 38, "32B)" should be --31B)--.

At column 28, line 30, "48A)" should be --47A)--.

At column 28, line 49, "48B)" should be --47B)--.

At column 33, line 45, "63A)" should be --62A)--.

At column 33, line 59, "63B)" should be --62B)--.

At column 38, line 66, "75A)" should be --74A)--.

At column 40, line 1, "75B)" should be --74B)--.

Signed and Sealed this

Seventh Day of December, 1993

*Attest:*

*Attesting Officer*

Bruce Lehman

BRUCE LEHMAN

*Commissioner of Patents and Trademarks*